US008725018B2

(12) United States Patent
Sato

(10) Patent No.: US 8,725,018 B2
(45) Date of Patent: May 13, 2014

(54) IMAGE FORMING APPARATUS

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 646 days.

(21) Appl. No.: 13/020,056

(22) Filed: Feb. 3, 2011

(65) Prior Publication Data

US 2011/0200344 A1 Aug. 18, 2011

(30) Foreign Application Priority Data

Feb. 12, 2010 (JP) ..... 2010-029364

(51) Int. Cl.
*G03G 15/20* (2006.01)

(52) U.S. Cl.
USPC ..... 399/68; 399/69

(58) Field of Classification Search
USPC ..... 399/33, 67–70
See application file for complete search history.

(56) References Cited

U.S. PATENT DOCUMENTS 4,897,696 A * 1/1990 Matsumoto ..... 399/33

FOREIGN PATENT DOCUMENTS

JP 07-064436 A 3/1995
JP 2003098935 A * 4/2003

OTHER PUBLICATIONS

Hamano (JP 2003-098935 A), Apr. 2003, JPO Machine Translation.*

* cited by examiner

*Primary Examiner* — David Gray
*Assistant Examiner* — Erika J Villaluna
(74) *Attorney, Agent, or Firm* — Marvin A. Motsenbocker; Mots Law, PLLC

(57) ABSTRACT

When the temperature of a fixing section has not reached a fixable temperature and the condition of an image forming apparatus is an abnormal temperature rising condition, a print controller causes a toner image conveying section to move a toner image on an intermediate transfer member to a predetermined toner image standby position upstream of a secondary transfer section and to put the toner image on standby at the toner image standby position, and causes a recording medium conveying section to put a recording medium on standby at a predetermined sheet standby position upstream of the secondary transfer section. Thereafter, when the temperature of the fixing section reaches the fixable temperature, the print controller causes the secondary transfer section to transfer the toner image on the intermediate transfer member onto the recording medium.

12 Claims, 14 Drawing Sheets

FIRST EMBODIMENT

FIRST EMBODIMENT

FIRST EMBODIMENT (NORMAL TEMPERATURE RISING CONDITION)

t = t0, t = t1 t = t2 t = t3 t = t4 t = t5

FIRST EMBODIMENT (NORMAL TEMPERATURE RISING CONDITION)

FIRST EMBODIMENT (ABNORMAL TEMPERATURE RISING CONDITION)

t = t10 t = t11 t = t12, t = t13 t = t14 t = t15

FIRST EMBODIMENT (ABNORMAL TEMPERATURE RISING CONDITION)

SECOND EMBODIMENT

SECOND EMBODIMENT

SECOND EMBODIMENT

SECOND EMBODIMENT

SECOND EMBODIMENT

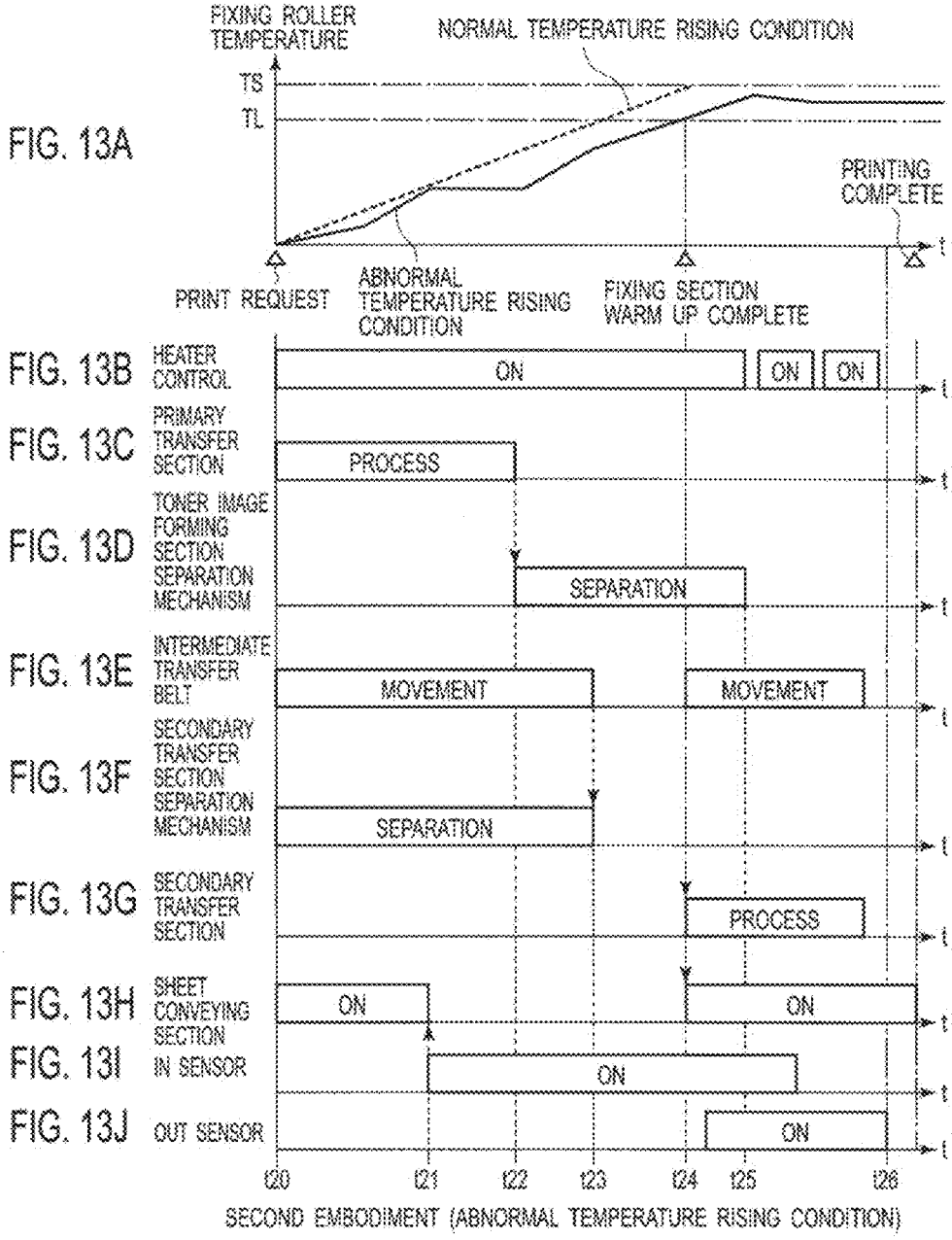
SECOND EMBODIMENT (ABNORMAL TEMPERATURE RISING CONDITION)

t = t20 t = t21 t = t22 t = t23, t = t24 t = t25 t = t26

SECOND EMBODIMENT (ABNORMAL TEMPERATURE RISING CONDITION)

IMAGE FORMING APPARATUS

CROSS REFERENCE TO RELATED APPLICATIONS

This application claims priority based on 35 USC 119 from prior Japanese Patent Application No. P2010-029364 filed on Feb. 12, 2010, entitled "IMAGE FORMING APPARATUS", the entire contents of which are incorporated herein by reference.

BACKGROUND OF THE INVENTION

1. Field of the Invention

The invention relates to an image forming apparatus including a fixing section configured to fix a toner image onto a recording medium.

2. Description of the Related Art

An image forming apparatus using an electrophotographic method, for example, an electrophotographic printer includes a fixing section configured to fix toner images, which are transferred onto a sheet as a recording medium, onto the sheet with heat and pressure. For example, Japanese Patent Application Publication No. Hei 7-64436 (Abstract and FIG. 1) proposes an image forming apparatus configured to: find a rise time (an estimated value) needed for the temperature of the fixing section to reach a fixable temperature from a table on the basis of a result of detecting the temperature of the fixing section; and start to convey a sheet (to feed a sheet) if this rise time is judged as being shorter than a time needed for a sheet to be conveyed to the fixing section.

SUMMARY OF THE INVENTION

However, there is a likelihood that the image quality may deteriorate because the images fail to be fixed satisfactorily.

An object of an aspect of the invention is to improve the image quality.

An aspect of the invention is an image forming apparatus including: a toner image forming section including an image carrier, and configured to form a toner image on the image carrier; a toner image conveying section including an intermediate transfer member and a moving part configured to move the intermediate transfer member in a predetermined movement direction; a primary transfer section configured to transfer the toner image on the image carrier onto the intermediate transfer member; a recording medium conveying section configured to convey a recording medium in a predetermined conveyance direction; a secondary transfer section configured to transfer the toner image on the intermediate transfer member onto the recording medium; a fixing section including a heater, and configured to heat the toner image on the recording medium with the heater; a fixability judging part configured to judge whether or not a temperature of the fixing section reaches a fixable temperature; a condition judging part configured to judge whether or not a condition of the image forming apparatus following input of a first print request into the image forming apparatus is an abnormal temperature rising condition in which an estimated value of a rise time needed for the temperature of the fixing section to reach the fixable temperature exceeds a predetermined reference time; and a print controller. When the fixability judging part judges that the temperature of the fixing section has not reached the fixable temperature yet and the condition judging part judges that the condition of the image forming apparatus is the abnormal temperature rising condition, the print controller causes the toner image conveying section to move the toner image on the intermediate transfer member to a predetermined toner image standby position upstream of the secondary transfer section in the movement direction and to put the toner image on standby at the toner image standby position, and causes the recording medium conveying section to put the recording medium on standby at a predetermined sheet standby position upstream of the secondary transfer section in the conveyance direction. Thereafter, when the fixability judging part judges that the temperature of the fixing section reaches the fixable temperature, the print controller causes the secondary transfer section to transfer the toner image on the intermediate transfer member onto the recording medium.

According to the aspect of the invention, the image quality is improved.

BRIEF DESCRIPTION OF THE DRAWINGS

FIGS. 13A to 13J are timing charts illustrating how the image forming apparatus of the second embodiment operates while in the abnormal temperature rising condition.

DETAILED DESCRIPTION OF PREFERRED EMBODIMENTS

Figure 1:
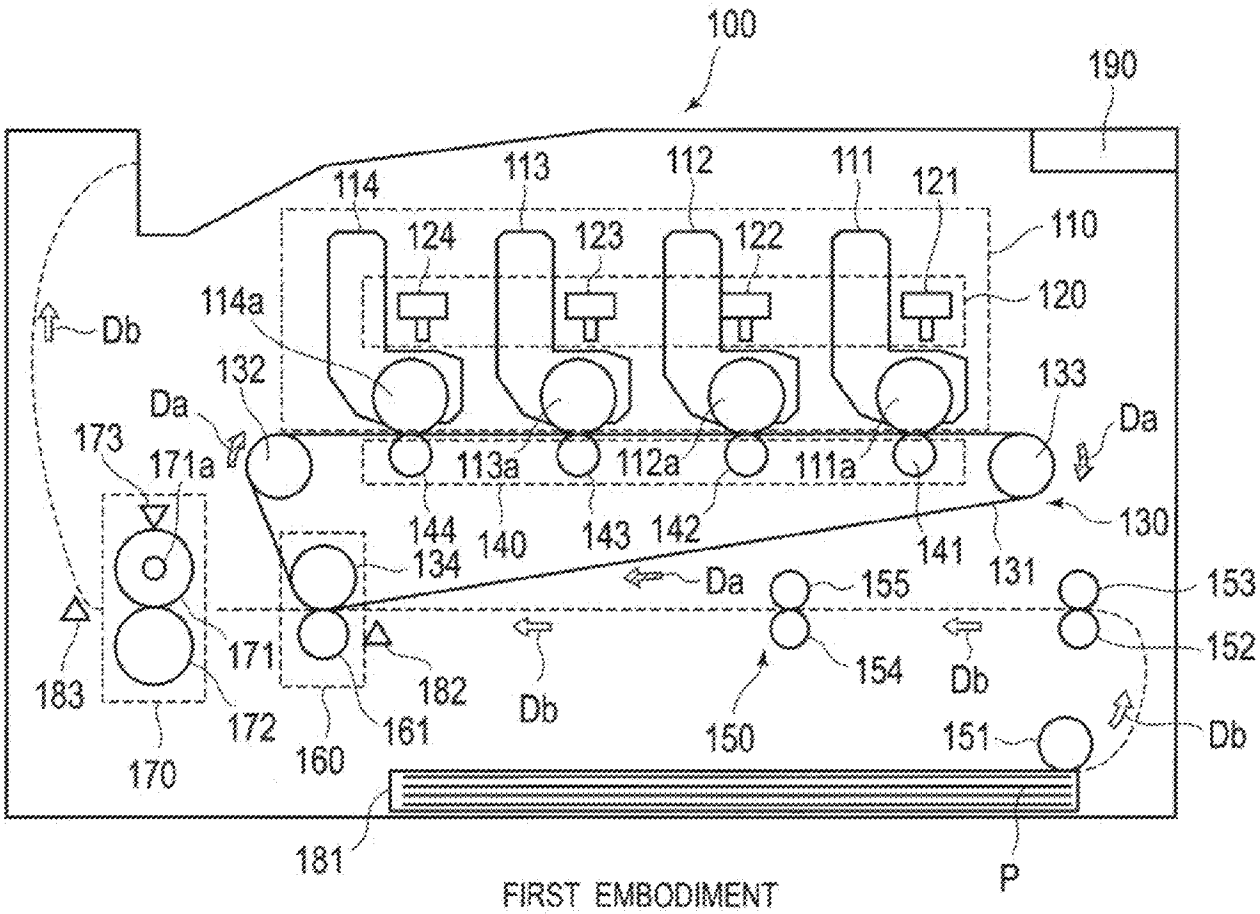
FIG. 1 is a side cross-section view schematically illustrating a configuration of an image forming apparatus of a first embodiment of the invention.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

FIG. 1 is a diagram schematically illustrating a configuration of image forming apparatus 100 of a first embodiment of the invention. Image forming apparatus 100 is an electrophotographic color image forming apparatus. Examples of image forming apparatus 100 include printers, facsimiles, copiers, multiple-function peripherals (MFPs), and the like.

As shown in FIG. 1, image forming apparatus 100 of the first embodiment includes, as its main components: toner image forming section 110 configured to form toner images on photosensitive drums 111*a*, 112*a*, 113*a*, and 114*a* or image carriers; exposing sections 120 configured to expose recording light for forming electrostatic latent images on the respective image carriers; toner image conveying section 130 including intermediate transfer member 131 or an intermediate transfer member; primary transfer section 140 configured to transfer the toner images from the respective image carriers to the intermediate transfer member; sheet conveying section 150 as a recording medium conveying section; secondary transfer section 160 configured to transfer the toner images from the intermediate transfer member to sheet P as a recoding medium; fixing section 170 configured to fix the toner images onto sheet P; and manipulation panel 190 as a user manipulation section through which a user performs various settings. Image forming apparatus 100 further includes: sheet cassette 181 in which sheets P are stacked; IN sensor 182 placed in a predetermined position upstream of secondary transfer section 160 in a sheet conveying direction Db, and serving as a sheet sensor configured to detect a sheet conveyance position; and OUT sensor 183 placed in a predetermined position downstream of fixing section 170 in the sheet conveying direction Db, and serving as the other sheet sensor configured to detect a sheet conveyance position.

Toner image forming section 110 includes toner image forming units 111, 112, 113, 114 for the respective colors (for example, black, yellow, magenta and cyan). Image forming units 111, 112, 113, 114 respectively include photosensitive drums 111*a*, 112*a*, 113*a*, 114*a* as the image carriers for the colors. It should be noted that, although FIG. 1 shows four toner image forming units 111, 112, 113, 114, the number of toner image forming units may be any number other than four, for example, any number of one to three, or any number not smaller than five.

Exposing section 120 includes LED heads 121, 122, 123, 124 provided with LED arrays, and serving as light source units for the colors, as well as configured to emit rays of light (rays of recording light) for forming the electrostatic latent images on photosensitive drums 111*a*, 112*a*, 113*a*, 114*a*. It should be noted that, instead of the LED heads, other light sources such as laser light sources may be used.

Toner image conveying section 130 includes: endless intermediate transfer belt 131 having no joint, and serving as the intermediate transfer member; and driving roller 132, belt coupled-driving roller 133 and secondary transfer backup roller 134 around which intermediate transfer belt 131 is wound. Intermediate transfer belt 131 is made of, for example, a semi-conductive plastic film having a high resistance. Driving roller 132 is configured to convey the toner images on intermediate transfer belt 131 in a movement direction Da by: rotating itself with a driving force which is transmitted from an intermediate transfer section driving mechanism including a driving motor (intermediate transfer belt moving motor 135 shown in FIG. 2 described later); and thereby moving intermediate transfer belt 131 in the movement direction Da.

Primary transfer section 140 has primary transfer rollers 141, 142, 143, 144 for the colors in positions which are respectively opposed to photosensitive drums 111*a*, 112*a*, 113*a*, 114*a* with intermediate transfer belt 131 interposed in between. Primary transfer rollers 141, 142, 143, 144 are configured to respectively transfer (perform primary transfer of) the single-color toner images, which are formed on photosensitive drums 111*a*, 112*a*, 113*a*, 114*a*, onto intermediate transfer belt 131. The single-color toner images transferred onto intermediate transfer belt 131 are made into a multi-color toner image by being superimposed one on another on intermediate transfer belt 131.

Sheet conveying section 150 includes: pickup roller 151 configured to feed sheets P, with which sheet cassette 181 is loaded, on the one-by-one basis; paired sheet conveying rollers 152, 153, and paired sheet conveying rollers 154, 155, configured to convey sheet P, which is picked up by pickup roller 151, in the sheet conveying direction Db; and other conveying rollers, which are not illustrated.

Secondary transfer section 160 includes: secondary transfer backup roller 134 (which is a component of toner image conveying section 130 as well); and secondary transfer roller 161 placed opposite to secondary transfer backup roller 134 with intermediate transfer belt 131 interposed in between. Secondary transfer roller 161 is, for example, a semi-conductive roller having a high resistance, and is in contact with intermediate transfer belt 131 in a position opposed to secondary transfer backup roller 134. Secondary transfer section 160 is configured to transfer the toner images that have been transferred onto intermediate transfer belt 131 (primary transfer) onto sheet P (secondary transfer).

Fixing section 170 includes: fixing roller 171 as a heating/pressing member configured to apply heat and pressure to sheet P and the toner images transferred onto sheet P; press roller 172 opposed to and in contact with fixing roller 171 (or in contact with fixing roller 171 with sheet P interposed in between), and serving as a press member configured to apply pressure to the toner images and sheet P. As a heating device, heater 171*a* is provided inside fixing roller 171. Fixing section 170 further includes thermistor 173 as a temperature detector configured to detect the temperature of the surface or vicinity of fixing roller 171. Incidentally, the structure of fixing section 170 is not limited to the illustrated structure.

Manipulation panel 190 includes a display device (not illustrated) such as a liquid crystal panel; and a manipulation device (not illustrated) such as manipulation buttons. For example, manipulation panel 190 displays setting items on the display device, and a user inputs various setting items by use of the manipulation device while looking at the displayed contents on the display device.

Figure 2:
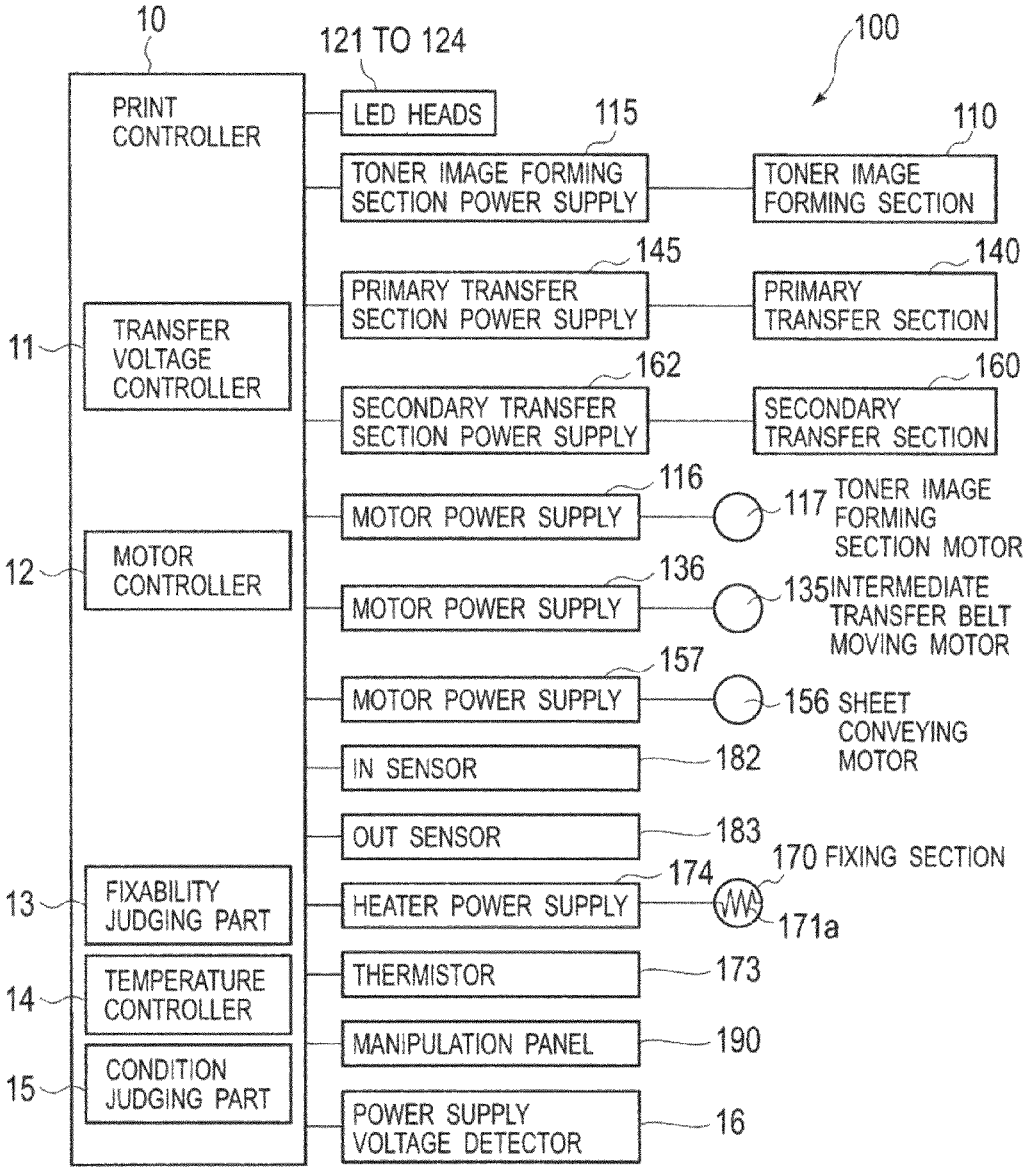
FIG. 2 is a block diagram schematically illustrating a configuration of a control system of the image forming apparatus of the first embodiment.

FIG. 2 is a block diagram schematically illustrating a configuration of a control system of image forming apparatus 100 of the first embodiment. As shown in FIG. 2, image forming apparatus 100 includes: print controller 10 configured to control the printing operation; LED heads 121, 122, 123, 124 as exposing section 120 configured to emit rays of recoding light; toner image forming section 110; toner image forming section power supply 115 configured to supply electric power to toner image forming section 110; primary transfer section 140; and primary transfer section power supply 145 configured to supply electric power to primary transfer section 140. Image forming apparatus 100 further includes: secondary transfer unit 160; secondary transfer section power supply 162 configured to supply electric power to secondary transfer section 160; one or multiple toner image forming section motors 115 configured to drive the components of toner image forming units 111, 112, 113, 114 in toner image forming section 110; and motor power supply 116 configured to supply electric power to toner image forming section motor 117. Image forming apparatus 100 additionally includes: intermediate transfer belt moving motor 135 configured to provide a driving force for moving intermediate transfer belt 131 to driving roller 132; motor power supply 136 configured to provide electric power to intermediate transfer belt moving motor 135; sheet conveying motor 156; motor power supply 157 configured to provide electric power to sheet conveying motor 156; IN sensor 182; OUT sensor 183; fixing section 170 including heater 171*a*; heater power supply 174 configured to supply electric power to heater 171*a*; thermistor 173 configured to detect the temperature of fixing section 170 (for example, the surface or vicinity of fixing roller 171); and manipulation panel 190. Image forming apparatus 100 may further include power supply voltage detector 16 configured to detect a power supply voltage (for example, a power supply voltage from an electric outlet) supplied to image forming apparatus 100.

Print controller 10 includes: transfer voltage controller 11 configured to control voltages to be respectively applied to primary transfer section 140 and secondary transfer section 160; motor controller 12 configured to control the drives of the motors including toner image forming section motor 117, intermediate transfer belt moving motor 135 and sheet conveying motor 156; fixability judging part 13 configured to judge whether or not the temperature of fixing section 170 reaches a fixable temperature (that is, printable temperature) on the basis of a result of detecting the temperature of the surface of fixing roller 171 which is acquired by thermistor 173; and temperature controller 14 configured to control the temperature of the surface of fixing roller 171 to a predetermined temperature. Print controller 10 further includes condition judging part 15 configured to judge whether a condition of the image forming apparatus following the input of the first print request into the image forming apparatus (for example, following the turning on of the power supply of the image forming apparatus) is a "normal temperature rising condition" (shown in FIGS. 4 and 5 described later) or an "abnormal temperature rising condition" (shown in FIGS. 6 and 7 described later). In this respect, "normal temperature rising condition" means a condition in which an estimated value of the rise time needed for the temperature of fixing section 170 to reach a fixable temperature (fixable lower limit) TL is equal to or shorter than a predetermined reference length of time to (shown in FIGS. 4 and 6 described later). The "abnormal temperature rising condition" means a condition in which the estimated value of the rise time exceeds the reference length of time. Incidentally, the condition of the image forming apparatus following the input of the first print request into the image forming apparatus is, for example, a condition which lasts for a predetermined period of time immediately after the input of the first print request into the image forming apparatus, but may be a condition which starts a short while after the input of the first print request into the image forming apparatus and lasts for a predetermined period of time.

FIG. 2 is described on the assumption that transfer voltage controller 11, motor controller 12, fixability judging part 13, temperature controller 14 and condition judging part 15 are parts of print controller 10. However, these components may be separate from print controller 10. In addition, FIG. 2 is described on the assumption that power supply voltage detector 16 is a component separate from print controller 10. However, this component may be a part of print controller 10.

Condition judging part 15 is configured to judge whether the condition following the input of the first print request is the "normal temperature rising condition" or the "abnormal temperature rising condition," for example, on the basis of the temperature which is detected by thermistor 173. This judging method based on the temperature to be detected by thermistor 173 is hereinafter referred to as a "first condition judging method" for the sake of convenience.

The first condition judging method is now described in detail. Condition judging part 15 calculates amounts of change in the temperature that is detected by thermistor 173 at intervals of a predetermined length of time (for example, at intervals of one second) for the predetermined period of time (for example, 5 seconds) after the input of the first print request into the image forming apparatus. For example, if at least one of the amounts of change in the temperature thus calculated is equal to or larger than an amount-of-change threshold value, condition judging part 15 judges that the condition of image forming apparatus 100 is the "normal temperature rising condition." If all of the amounts of change in the temperature are smaller than the amount-of-change threshold value, condition judging part 15 judges that the condition of image forming apparatus is the "abnormal temperature rising condition." These judgments are equivalent to a judgment of whether a rate (pitch) of rise in the temperature of thermistor 173 is not less or less than a predetermined threshold value. Incidentally, the predetermined length of time following the input of the first print request is not limited to 5 seconds, and the intervals of the predetermined length of time are not limited to intervals of the one second.

Alternatively, another judgment scheme may be used in order to make condition judging part 15 judge that the condition of image forming apparatus 100 is the "abnormal temperature rising condition" if the number of calculated amounts of change in the temperature that are less than a predetermined amount-of-change threshold value is equal to or greater than a predetermined number (for example, if half or more of the calculated amounts of change in the temperature are less than the predetermined amount-of-change threshold value).

Otherwise, condition judging part 15 may be configured to: compare a maximum value or an average value of the calculated amounts of change in the temperature with a predetermined threshold value; judge that the condition following the input of the first print request is the "normal temperature rising condition" if the maximum value or the average value is equal to or greater than the predetermined threshold value; and judge that the condition is the "abnormal temperature rising condition" if otherwise.

The "abnormal temperature rising condition" (shown in FIGS. 6 and 7 described later) judged by condition judging part 15 occurs, for example, if the power supply voltage applied to heater 171*a* of fixing section 170 is a low voltage when the power supply of the image forming apparatus is turned on. Because the power supply voltage from the electric outlet is usually applied to heater 171*a* directly, the rise in the temperature of fixing section 170 is influenced by the fluctuation in the power supply voltage from the electric outlet to a large extent. In a case where the "abnormal temperature rising condition" occurs because the power supply voltage applied to heater 171*a* of fixing section 170 is a low voltage, the "abnormal temperature rising condition" is referred to as a "low voltage condition" as well.

Moreover, condition judging part 15 may use a second condition judging method, which is described below, instead of the first condition judging method. In the case where condition judging part 15 uses the second condition judging method, condition judging part 15 judges whether the condition following the input of the first print request is the "normal temperature rising condition" or the "abnormal temperature rising condition" on the basis of the power supply voltage which is detected by power supply voltage detector 16 for the predetermined period of time after the input of the first print request (for example, after the turning on of the power supply of the image forming apparatus). On this occasion, condition judging part 15 detects the power supply voltage at intervals of the predetermined length of time (for example, at intervals of one second) for the predetermined period of time (for example, 5 seconds) after the input of the first print request. Subsequently, condition judging part 15 judges that the condition of image forming apparatus 100 is the "normal temperature rising condition," for example, if one or more of the thus-detected power supply voltages are equal to or greater than a voltage threshold value, and judges that the condition of image forming apparatus 100 is the "abnormal temperature rising condition" if all of the power supply voltages are less than the voltage threshold value.

Alternatively, another judgment scheme may be used in order to make condition judging part 15 judge that the condition of image forming apparatus 100 is "abnormal temperature rising condition" if the number of calculated amounts of power supply voltages which are less than a predetermined voltage threshold value is equal to or more than a predetermined number (for example, if half or more of the calculated amounts of power supply voltages are less than the predetermined voltage threshold value).

Otherwise, condition judging part 15 may be configured to: compare a maximum value or an average value of the calculated power supply voltages with a predetermined voltage threshold value; judge that the condition following the input of the first print request is the "normal temperature rising condition" if the maximum value or the average value is equal to or greater than the predetermined voltage threshold value; and judge that the condition is the "abnormal temperature rising condition" if otherwise.

In addition, on the basis of the user's input through manipulation panel 190, an operation to be performed when the condition of the image forming apparatus is the "abnormal temperature rising condition" is executed by print controller 10. For example, when the user knows beforehand the drop of the power supply voltage (such as when fixation failure occurs in one of multiple image forming apparatuses of the same type used by the user) the operation to be performed when the condition of the image forming apparatus is the "abnormal temperature rising condition" is executed on the basis of the user's input.

Print controller 10 controls as follows when: fixability judging part 13 judges that the temperature of fixing section 170 does not reach the fixable temperature; and condition judging part 15 judges that the condition of image forming apparatus 100 following the input of the first print request is the "abnormal temperature rising condition." In this case, print controller 10 causes toner image conveying section 130 to put the toner images on intermediate transfer member 131 on standby at a predetermined toner image standby position upstream of secondary transfer section 160 in the movement direction Da after moving the toner image there. In addition, print controller 10 causes sheet conveying section 150 to put sheet P on standby at a predetermined sheet standby position upstream of secondary transfer section 160 in the conveyance direction Db. Thereafter, when the temperature of fixing section 170 is judged to have reached the fixable temperature, print controller 10 causes toner image conveying section 130 to move intermediate transfer belt 131 in the movement direction Da, sheet conveying section 150 to convey sheet P in the conveyance direction Db, and secondary transfer section 160 to transfer the toner images on intermediate transfer belt 131 onto sheet P. Incidentally, in a case where the conveyance speed of sheet P is sufficiently fast, the standby position of sheet P may be the inside of sheet cassette 181.

Next, operation of image forming apparatus 100 of the first embodiment is described. Upon receipt of a print instruction through the user's input or a print instruction from an external apparatus (not illustrated) such as a host computer, print controller 10 causes LED heads 121, 122, 123, 124 to form electrostatic latent images on photosensitive drums 111*a*, 112*a*, 113*a*, 114*a* of toner image forming section 110 by emitting rays of recording light onto photosensitive drums 111*a*, 112*a*, 113*a*, 114*a* in accordance with print data. Subsequently, print controller 10 causes a developing section (not illustrated) of toner image forming section 110 to develop the electrostatic latent images on photosensitive drums 111*a*, 112*a*, 113*a*, 114*a* to form toner images on photosensitive drums 111*a*, 112*a*, 113*a*, 114*a*. It should be noted that the control of the drive and stop of toner image forming section motor 117 is implemented by motor power supply 116 on the basis of a control signal from motor controller 12. In addition, the control of the drive and stop of intermediate transfer belt moving motor 135 is implemented by motor power supply 136 on the basis of a control signal from motor controller 12.

Transfer voltage controller 11 in print controller 10 causes primary transfer section power supply 145 to apply a voltage to primary transfer section 140 at an appropriate time, and thus causes primary transfer section 140 to transfer the toner images, which are formed on photosensitive drums 111*a*, 112*a*, 113*a*, 114*a*, onto intermediate transfer belt 131 with the toner images superimposed one on another (primary transfer). Motor controller 12 in print controller 10 causes sheet conveying section 150 to convey sheet P in accordance with an image forming timing by controlling the supply of electric power to motor power supply 157.

Once the toner images on intermediate transfer belt 131 and sheet P are conveyed to secondary transfer section 160, transfer voltage controller 11 in print controller 10 causes secondary transfer voltage power supply 162 to apply a voltage to secondary transfer section 160 at an appropriate time, and thus causes secondary transfer section 160 to transfer the toner images onto sheet P (secondary transfer).

Thereafter, once sheet P is conveyed to fixing section 170 by sheet conveying section 150, temperature controller 14 in print controller 10 controls the temperature of fixing section 170 by controlling heater power supply 174, and causes the toner images on sheet P to be fixed onto sheet P by applying heat and pressure. Sheet P onto which the toner images are fixed is conveyed and discharged out of the apparatus.

Figure 3:
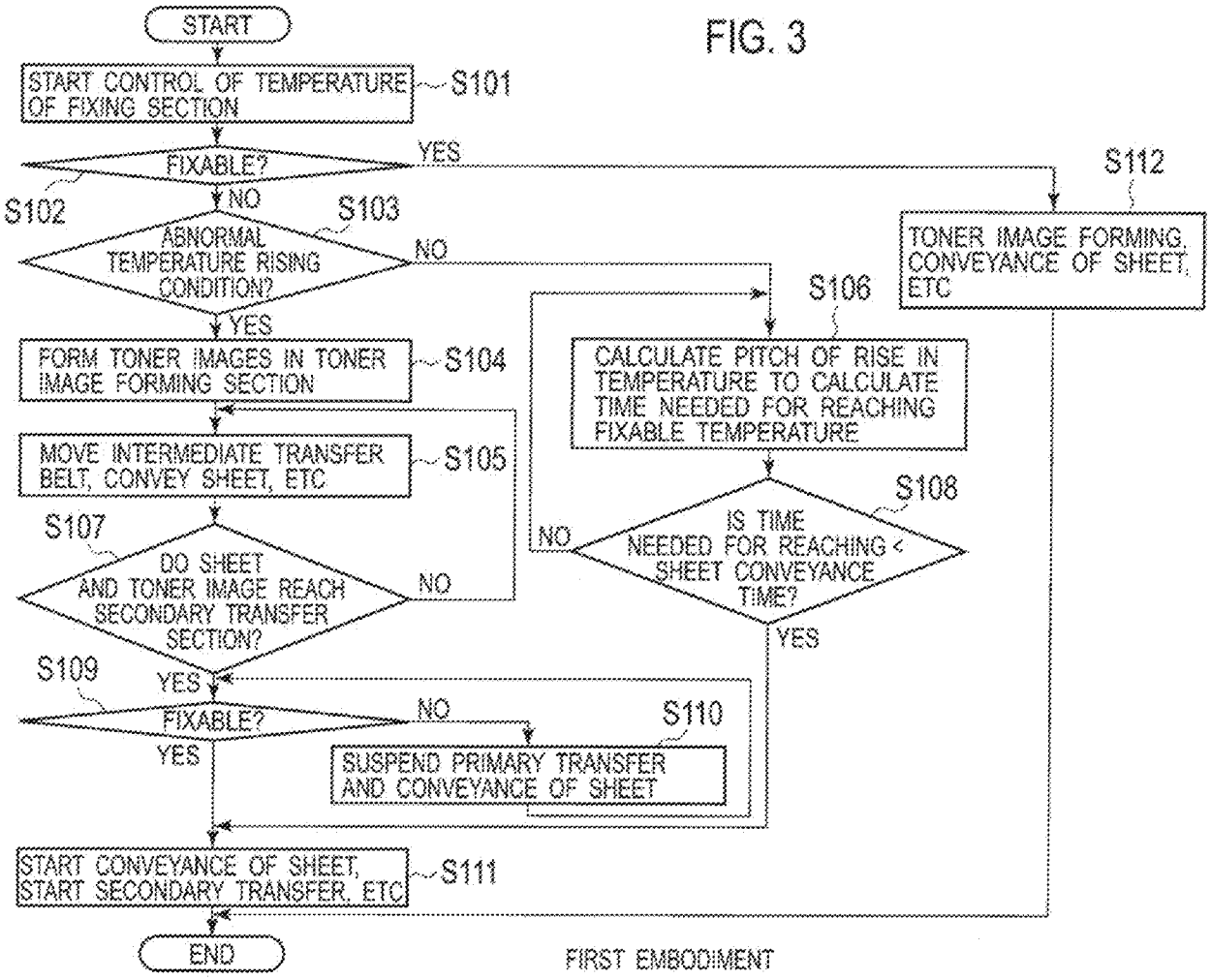
FIG. 3 is a flowchart illustrating how the image forming apparatus of the first embodiment operates.

Next, operation of image forming apparatus 100 of the first embodiment is described in detail. FIG. 3 is a flowchart illustrating operation of image forming apparatus 100 of the first embodiment. Upon reception of the first print request from the external apparatus (not illustrated), print controller 10 causes heater power supply 174 to supply electric power to heater 171*a* of fixing section 170, and thus starts to control the temperature of fixing section 170 (in step S101).

On the basis of a detection signal from thermistor 173 configured to output the detection signal in accordance with the temperature of fixing section 170, fixability judging part 13 in print controller 10 judges whether or not the temperature of fixing section 170 falls within the predetermined fixable (printable) temperature range (in step S102). If fixability judging part 13 judges in step S102 that the temperature of fixing section 170 is equal to or higher than a predetermined printable temperature, print controller 10 carries out a process (print process) for: forming toner images on photosensitive drums 111*a*, 112*a*, 113*a*, 114*a*; performing the primary transfer of the toner images onto intermediate transfer belt 131; starting the conveyance of sheet P; and performing the secondary transfer of the toner images onto sheet P (in step S112).

If fixability judging part 13 judges in step S102 that the temperature of fixing section 170 is lower than the fixable temperature, condition judging part 15 in print controller 10 judges whether or not the condition of image forming apparatus 100 is the "abnormal temperature rising condition" (for example, the lower voltage condition) (in step S103).

If condition judging part 15 judges that the condition of image forming apparatus 100 is not the "abnormal temperature rising condition," or that the condition of image forming apparatus 100 is the "normal temperature rising condition," print controller 10 calculates a time (an estimated value of the rise time) needed for the temperature of fixing section 170 to reach the fixable temperature (in step S106). If the estimated value of the temperature-rise time is shorter than a sheet conveyance time (in step S108), print controller 10 carries out the print process including the conveyance of the sheet and the forming of the toner images. In this respect, the sheet conveyance time is a length of time needed to convey sheet P from sheet cassette 181 to fixing section 170.

If condition judging part 15 judges in step 103 that the condition of image forming apparatus 100 is the "abnormal temperature rising condition," print controller 10 causes toner image forming section 110 to start to form the toner images on photosensitive drums 111*a*, 112*a*, 113*a*, 114*a* (in step S104). On this occasion, print controller 10 causes toner image forming units 111, 112, 113, 114 in toner image forming section 110 to form their respective toner images, while transfer voltage controller 11 causes primary transfer power supply 145 to apply the voltage to primary transfer section 140 at the appropriate time.

Print controller 10 causes intermediate transfer belt 131 to move and sheet P to be conveyed in parallel to cause toner image forming section 110 to form the toner images (in step S105).

Subsequently, print controller 10 initiates conveyance of both the toner images on intermediate transfer belt 131 and sheet P to a position immediately before secondary transfer section 160. While sheet P is being conveyed by sheet conveying section 150, motor controller 12 stops the conveyance of sheet P at the time when print controller 10 detects the position of sheet P by use of IN sensor 182 (in step S107). The conveyance of the toner images to the position by the movement of intermediate transfer belt 131 is achieved by a scheme in which: print controller 10 calculates the position of the toner images on the basis of a rotation amount of the photosensitive drums and a rotation amount of intermediate transfer belt roller 132 (or the amount of movement of intermediate transfer belt 131); and print controller 10 causes motor controller 12 to stop the conveyance of the toner images by intermediate transfer belt 131 at the time when the toner images are judged as reaching the position immediately before secondary transfer section 160 (in step S107).

Afterward, fixability judging part 13 judges whether or not the temperature of fixing section 170 reaches the fixable temperature (in step S109). Until the temperature of fixing section 170 is judged to have reached the fixable temperature, print controller 10 puts the print operation on standby by causing motor controller 12 to suspend the conveyance of the toner images by intermediate transfer belt 131 (toner image conveying section 130) and the conveyance of sheet P by sheet conveying section 150 in the position immediately before secondary transfer section 160 (in step S110).

Thereafter, once fixability judging part 13 judges that fixing section 170 becomes ready for fixation after the temperature of fixing section 170 reaches the fixable temperature and falls within the predetermined temperature range, motor controller 12 causes toner image conveying section 130 to resume conveyance of the toner image and causes sheet conveying section 150 to resume conveyance of sheet P, and transfer voltage controller 11 causes secondary transfer section power supply 162 to resume the application of voltage to secondary transfer section 160. Thereby, the toner images are transferred onto sheet P (secondary transfer) (in step S111).

Furthermore, when print controller 10 causes sheet conveying section 150 to convey sheet P, sheet P passes fixing section 170. Fixing section 170 fixes the toner images to sheet P by applying heat and pressure thereto.

Figures 4A, 4B, 4C, 4D, 4E, 4F, 4G, 4H:
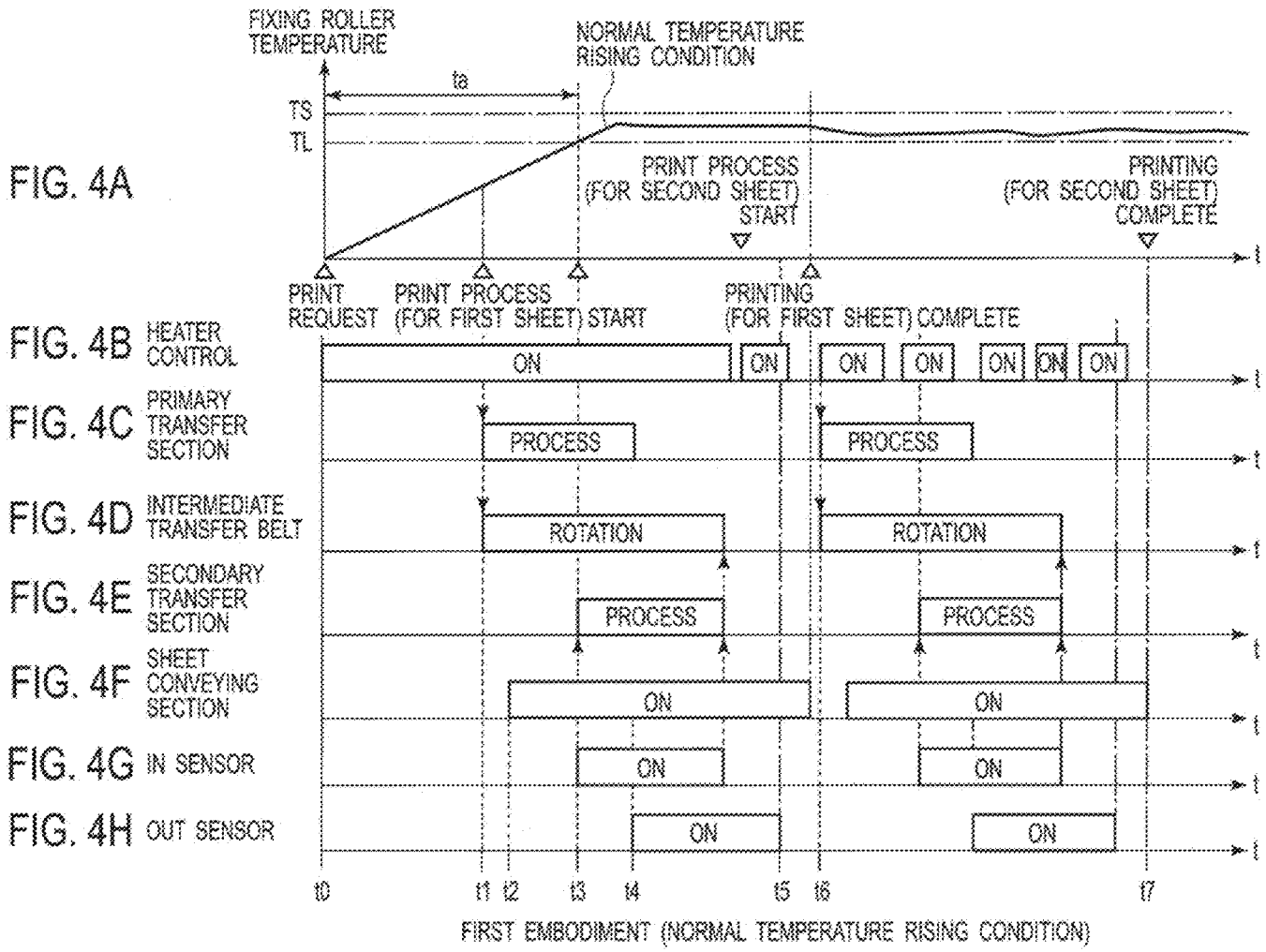
FIGS. 4A to 4H are timing charts illustrating how the image forming apparatus of the first embodiment operates while in a normal temperature rising condition.
Figure 5A:
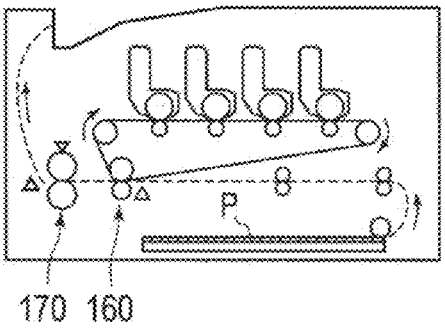
FIGS. 5A to 5E are diagrams for explaining how the image forming apparatus of the first embodiment operates while in the normal temperature rising condition.
Figure 5B:
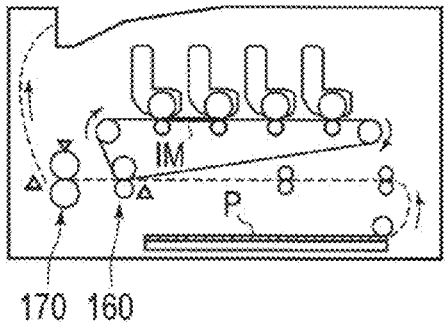
Figure 5C:
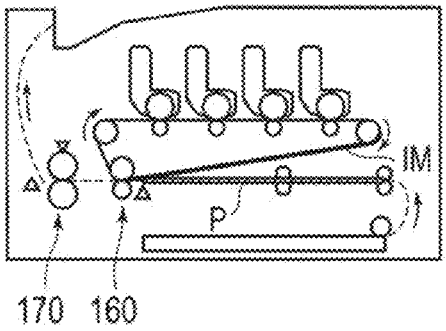
Figure 5D:
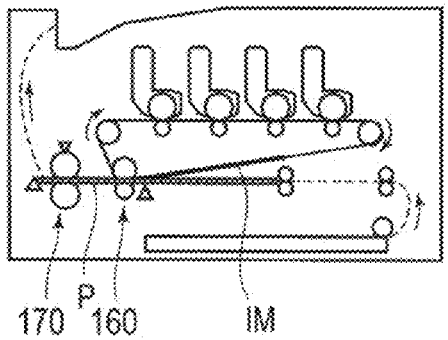
Figure 5E:
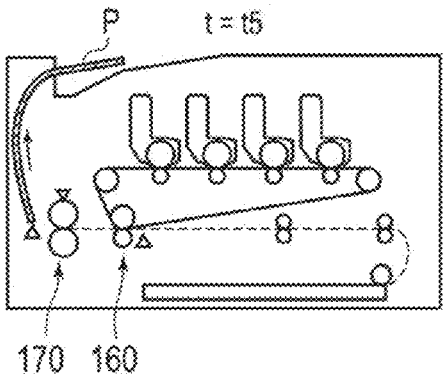

FIGS. 4A to 4H are timing charts illustrating operation of image forming apparatus 100 of the first embodiment in the case where, when receiving the first print request, the temperature of fixing section 170 is low and the condition of image forming apparatus 100 is the "normal temperature rising condition" (see the operation corresponding to steps S106, S108, S111 in the control flow shown in FIG. 3). FIG. 4A shows the temperature of fixing roller 171. FIG. 4B shows ON periods and OFF periods (periods other than the ON periods) of heater 171*a*. FIG. 4C shows periods of the process of primary transfer section 140. FIG. 4D shows periods of the movement of intermediate transfer belt 131. FIG. 4E shows periods of the process of secondary transfer section 160. FIG. 4F shows periods of the operation of sheet conveying section 150. FIG. 4G shows periods of the operation (the detection) of IN sensor 182. FIG. 4H shows periods of the operation (the detection) of OUT sensor 183.

FIGS. 5A to 5E are diagrams for explaining operation of image forming apparatus 100 of the first embodiment in the case where, when receiving the first print request, the temperature of fixing section 170 is low and the condition of image forming apparatus 100 is the "normal temperature rising condition" (see the operation corresponding to steps S106, S108, S111 in the control flow shown in FIG. 3). Time t0 to time t5 in FIGS. 4A to 4H are identical to time t0 to time t5 in FIGS. 5A to 5E.

Once the print process starts in response to the occurrence of the print request at time t0 (FIG. 4A), temperature controller 14 starts to control the heating of heater 171*a* (FIG. 4B). At time t0, no toner images IM are formed yet, and sheet P is not conveyed yet.

Time t1 (steps S106, S108 in FIG. 3) denotes time at which the estimated value of the rise time needed for the temperature of fixing section 170 to reach the fixable temperature which is found through the calculation becomes shorter than the time needed for sheet P to be conveyed to fixing section 170. It may be assumed that, if sheet P starts to be conveyed at this time, the temperature of fixing section 170 already reaches the fixable temperature when sheet P reaches fixing section 170. On this assumption, the print process starts. At this moment, temperature controller 14 continues controlling the heating of heater 171*a* (FIG. 4B); transfer voltage controller 11 and motor controller 12 start to control to cause primary transfer section 140 and toner image forming section 110 to form toner images IM on intermediate transfer belt 131 (FIG. 4C); and motor controller 12 starts to control the movement of intermediate transfer belt 131 (FIG. 4D). The position of sheet P at time t1 remains the same as the position of sheet P at time t0.

Time t2 denotes the time at which sheet P is judged to need to start to be conveyed for the purpose of equalizing the time needed for the leading edges of toner images IM to reach secondary transfer section 160 with the time needed for the leading edge of sheet P to reach secondary transfer section 160. If motor controller 12 causes sheet conveying section 150 to start to convey sheet P (FIG. 4F) at time t2, it is possible to have the leading edges of the respective toner images on intermediate transfer belt 131 and the leading edge of sheet P meet together at secondary transfer section 160. At time t2, toner images IM are already formed, but conveyance of sheet P is not yet started.

Time t3 denotes the time at which sheet P reaches secondary transfer section 160. The arrival of sheet P at secondary transfer section 160 is detected when IN sensor 182 (FIG. 4G) turns on. When secondary transfer section 160 (FIG. 4E) starts the secondary transfer process, toner images IM on intermediate transfer belt 131 are transferred onto sheet P. At time t3, both toner images IM and sheet P are situated immediately before secondary transfer section 160.

Time t4 denotes the time at which the leading edge of sheet P reaches OUT sensor 183. At time t4, parts of toner images IM are already transferred onto sheet P. Time t5 denotes the time at which the trailing edge of toner images IM pass OUT sensor 183. The continuing of the conveyance of sheet P discharges sheet P, on which toner images IM are printed, out of image forming apparatus 100. The print process for the first sheet thus ends.

Furthermore, while in the "normal temperature rising condition," as shown in FIG. 4A, image forming apparatus 100 can start part of the print process (a toner image forming process) for the second sheet before the completion of the print process for the first sheet. Thereby, image forming apparatus 100 can start the primary transfer process for the second sheet at time t6 which is the time immediately following the completion of the print process for the first sheet. Incidentally, time t7 denotes the time at which the print process for the second sheet is completed.

Figures 6A, 6B, 6C, 6D, 6E, 6F, 6G, 6H:
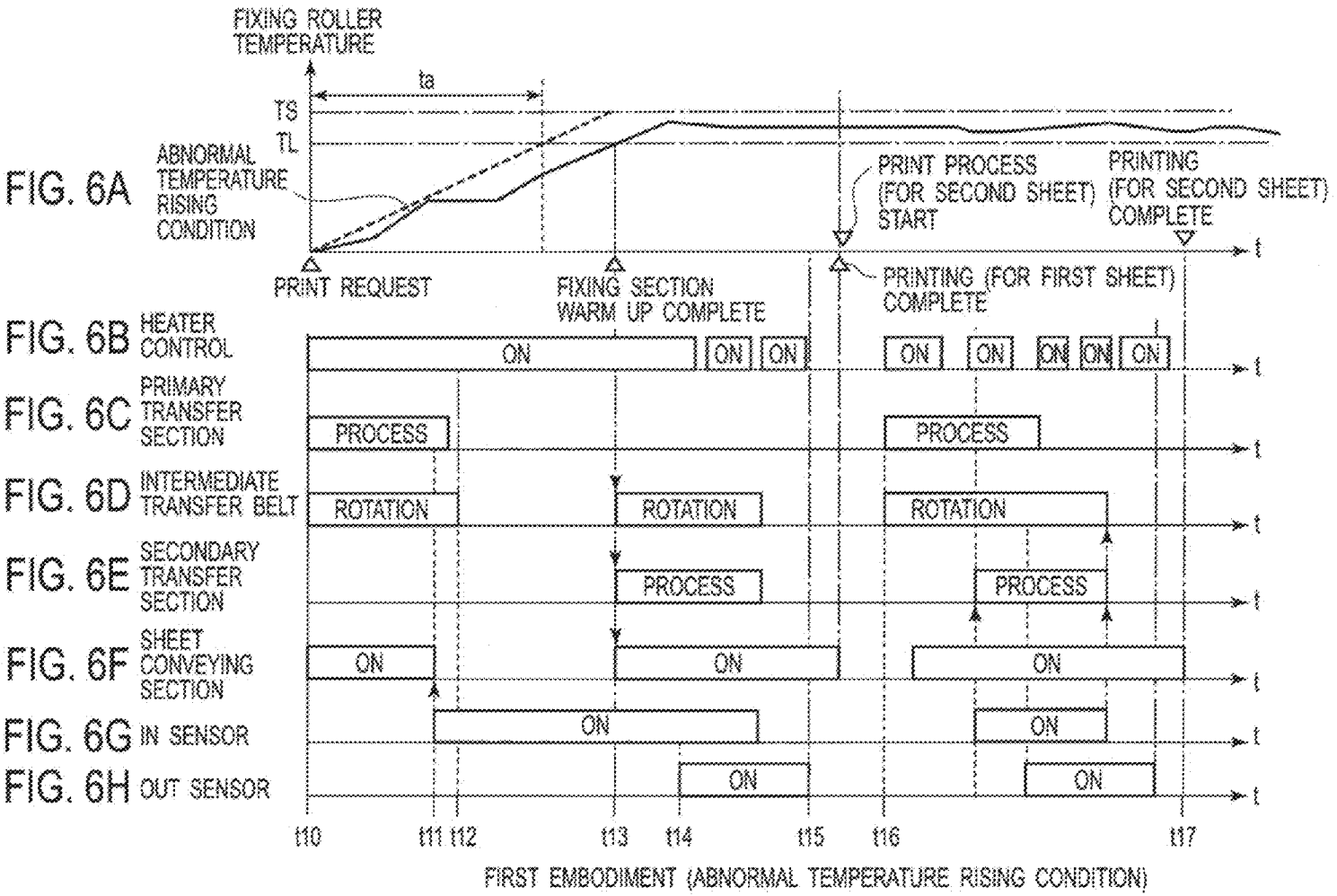
FIGS. 6A to 6H are timing charts illustrating how the image forming apparatus of the first embodiment operates while in an abnormal temperature rising condition.
Figure 7A:
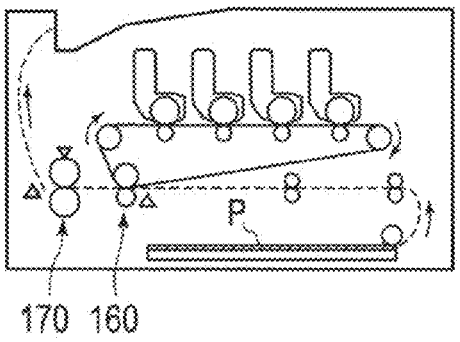
FIGS. 7A to 7E are diagrams for explaining how the image forming apparatus of the first embodiment operates while in the abnormal temperature rising condition.
Figure 7B:
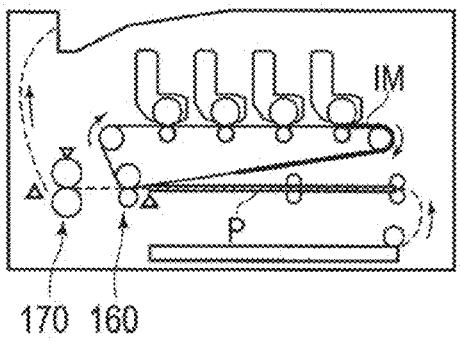
Figure 7C:
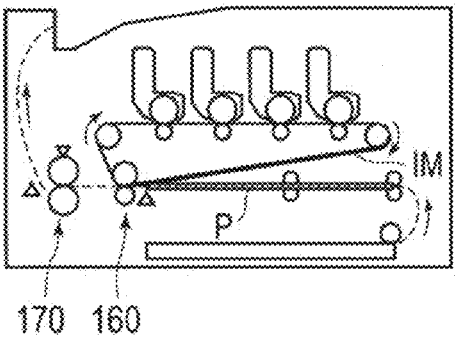
Figure 7D:
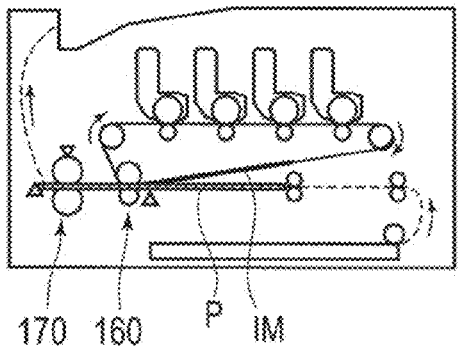
Figure 7E:
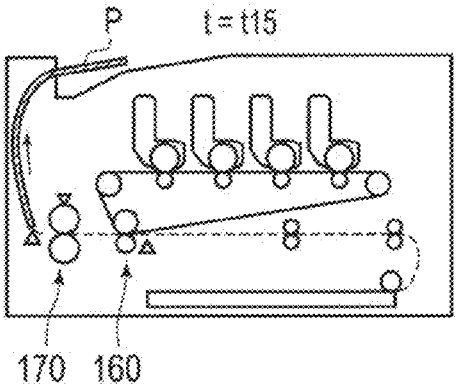

FIGS. 6A to 6H are timing charts illustrating operation of image forming apparatus 100 of the first embodiment in the case where, when receiving the first print request, the temperature of fixing section 170 is low and the condition of image forming apparatus 100 is the "abnormal temperature rising condition" (see the operation corresponding to steps S104, S105, S107, S109, S110, S111 in the control flow shown in FIG. 3). FIG. 6A shows the temperature of fixing roller 171. FIG. 6B shows ON periods and OFF periods (periods other than the ON periods) of heater 171*a*. FIG. 6C shows periods of the process of primary transfer section 140. FIG. 6D shows periods of the movement of intermediate transfer belt 131. FIG. 6E shows periods of the process of secondary transfer section 160. FIG. 6F shows periods of the operation of sheet conveying section 150. FIG. 6G shows periods of the operation of IN sensor 182. FIG. 6H shows periods of the operation of OUT sensor 183.

FIGS. 7A to 7E are diagrams for explaining operation of image forming apparatus 100 of the first embodiment in the case where, when receiving the first print request, the temperature of fixing section 170 is low and the condition of image forming apparatus 100 is the "abnormal temperature rising condition" (see the operation corresponding to steps S104, S105, S107, S109, S110, S111 in the control flow shown in FIG. 3). Time t10 to time t15 in FIGS. 6A to 6H are identical to time t10 to time t15 in FIGS. 7A to 7E.

Once the print process starts in response to the occurrence of the print request at time t10 (FIG. 6A), temperature controller 14 starts to control the heating of heater 171*a* (FIG. 6B); transfer voltage controller 11 and motor controller 12 start control to cause primary transfer section 140 and toner image forming section 110 to form toner images IM on intermediate transfer belt 131 (FIG. 6C); motor controller 12 starts to control the movement of intermediate transfer belt 131 (FIG. 6D); and motor controller 12 causes sheet conveying section 150 to start conveyance of sheet P (FIG. 6F). At time t10, no toner images IM are formed yet, and conveyance of sheet P is not yet started.

Time t11 denotes the time at which the conveyance of sheet P to the position immediately before secondary transfer section 160 is completed. Once print controller 10 detects the conveyance of sheet P to the position immediately before secondary transfer section 160 through the detection by IN sensor 182 (FIG. 6G), motor controller 12 suspends conveyance by sheet conveying section 150 (FIG. 6F). At time t11, toner images IM are in the process of being formed, and intermediate transfer belt 131 is being moved. However, sheet P is on standby in a standby position, for example, in a position immediately before secondary transfer section 160.

Time t12 denotes the time at which the forming of toner images IM is completed and the positions of the leading edges of toner images IM are located immediately before secondary transfer section 160. At time t12, the process of primary transfer section 140 and the process of toner image forming section 110, which are controlled by transfer voltage controller and motor controller 12, are completed (FIG. 6D), and intermediate transfer belt 131 stops on the basis of the control from motor controller 12 (FIG. 6D), as well.

Time t13 denotes the time at which the temperature of fixing section 170 reaches the fixable temperature, that is to say, the time at which the process for raising the temperature (a warm-up) is completed. The positions of toner images IM and the position of sheet P at time t13 remain the same as the positions of toner images IM and the position of sheet P at time t12. At time t13, print controller 10 starts the movement of intermediate transfer belt 131 (FIG. 6D), the secondary transfer process by secondary transfer section 160 (FIG. 6E) and the conveyance of sheet P by sheet conveying section 150 (FIG. 6F).

Time t14 denotes the time at which the leading edge of sheet P reaches OUT sensor 183 after passing fixing section 170. Toner images IM, which are transferred onto sheet P by secondary transfer section 160, are fixed onto sheet P by fixing section 170 by applying heat and pressure thereto.

Time t15 denotes the time at which the trailing edge of sheet P passes OUT sensor 183. Subsequently, the continuation of the conveyance of sheet P discharges sheet P, on which toner images IM are printed, out of image forming apparatus 100. The print process for the first sheet thus ends.

In the "abnormal temperature rising condition," as shown in FIG. 6A, image forming apparatus 100 can start the print process (a toner image forming process by the toner image forming section) for the second sheet after the completion of the print process for the first sheet. Thereby, image forming apparatus 100 can start the primary transfer process for the second sheet at time t16 which is the time shortly after formation of the toner images, i.e., the completion of the print process for the first sheet. The print processes for the second sheet and after is the same as the print processes in the normal temperature rising condition in FIGS. 4A to 4H and FIGS. 5A to 5E. Incidentally, time t17 denotes the time at which the print process for the second sheet is completed.

As described above, when fixability judging part 13 judges that the temperature of fixing section 170 does not reach the fixable temperature and condition judging part 15 judges that the condition of image forming apparatus 100 following the input of the first print request is the "abnormal temperature rising condition," image forming apparatus 100 of the first embodiment puts toner images IM on intermediate transfer member 131 on standby at the predetermined toner image standby position after moving toner images IM there, and puts sheet P on standby at the predetermined sheet standby position. Thereafter, when the temperature of fixing section 170 is judged to have reached the fixable temperature, image forming apparatus 100 causes intermediate transfer belt 131 to move, and sheet P to be conveyed; and causes secondary transfer section 160 to transfer toner images IM to sheet P. For this reason, once the temperature of fixing section 170 is judged to have reached the fixable temperature, image forming apparatus 100 is capable of causing secondary transfer section 160 to transfer toner images IM on intermediate transfer belt 131 to sheet P, and fixing section 170 to fix toner images IM to sheet P. Accordingly, image forming apparatus 100 of the first embodiment can reduce the time needed from the occurrence of the print request through the completion of the print, particularly, the time needed from the occurrence of the first print request through the completion of the print of the first sheet.

In addition, even in a case where the power supply voltage is unstable, image forming apparatus 100 of the first embodiment can reduce the frequency at which fixation failure occurs. That is because: image forming apparatus 100 completes part of the print process which is to be performed before secondary transfer section 160 undertakes its own part of the print process, and holds the remaining part of the print process in abeyance; and image forming apparatus 100 resumes the print process once fixing section 170 is judged to be ready for the fixation.

It should be noted that, after the power supply of the image forming apparatus is turned on, the temperature of the fixing section may not reach the fixable temperature within a rise time acquired from the table, in some cases such as a case where the voltage (for example, the power supply voltage from the electric outlet) to be applied to the heater in the fixing section fluctuates (for example, a case of a low voltage condition) and a case where the ambient temperature in the location of the image forming apparatus is low (in other words, a case of a low-temperature ambient condition). Under such a condition which makes it difficult to estimate the rise time needed for the temperature of the fixing section to reach the fixable temperature, the sheet is likely to reach the fixing section before the temperature of the fixing section reaches the fixable temperature. This causes a problem that the toner images fail in fixation. However, image forming apparatus 100 of the first embodiment can reduce the frequency at which the fixation failure occurs.

Furthermore, image forming apparatus 100 of the first embodiment makes it possible to reduce the distance between secondary transfer section 160 and fixing section 170. For this reason, image forming apparatus 100 can be easily constructed in a smaller size.

Moreover, image forming apparatus 100 of the first embodiment causes sheet conveying section 150 and toner image conveying section 130 to stop in standby until the temperature of fixing section 170 reaches the fixable temperature. For this reason, it is possible to reduce the power consumption of image forming apparatus 100.

Second Embodiment

Figure 8:
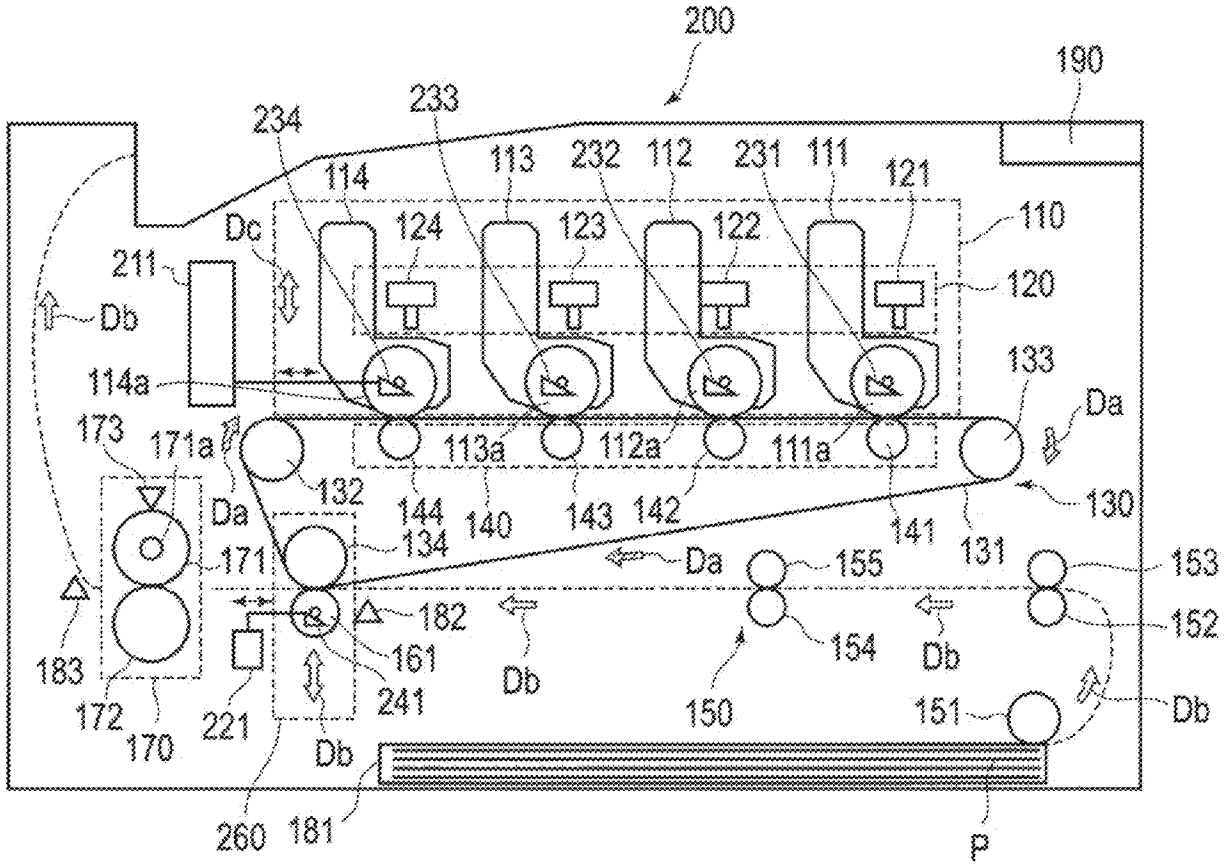
FIG. 8 is a diagram schematically illustrating a configuration of an image forming apparatus of a second embodiment of the invention.

FIG. 8 is a diagram schematically illustrating a configuration of image forming apparatus 200 of a second embodiment of the invention. In FIG. 8, components which are the same as those shown in FIG. 1 (the first embodiment) are denoted by the same reference signs. Image forming apparatus 200 of the second embodiment is different from image forming apparatus 100 shown in FIG. 1 (the first embodiment) in that image forming apparatus 200 further includes: first approximation/separation unit 210 configured to change the space between (to approximate and separate) intermediate transfer belt 131 and photosensitive drums 111*a*, 112*a*, 113*a*, 114*a*; and second approximation/separation unit 220 configured to change the space between (to approximate or separate) secondary transfer section 260 and secondary transfer roller 161.

Figure 9:
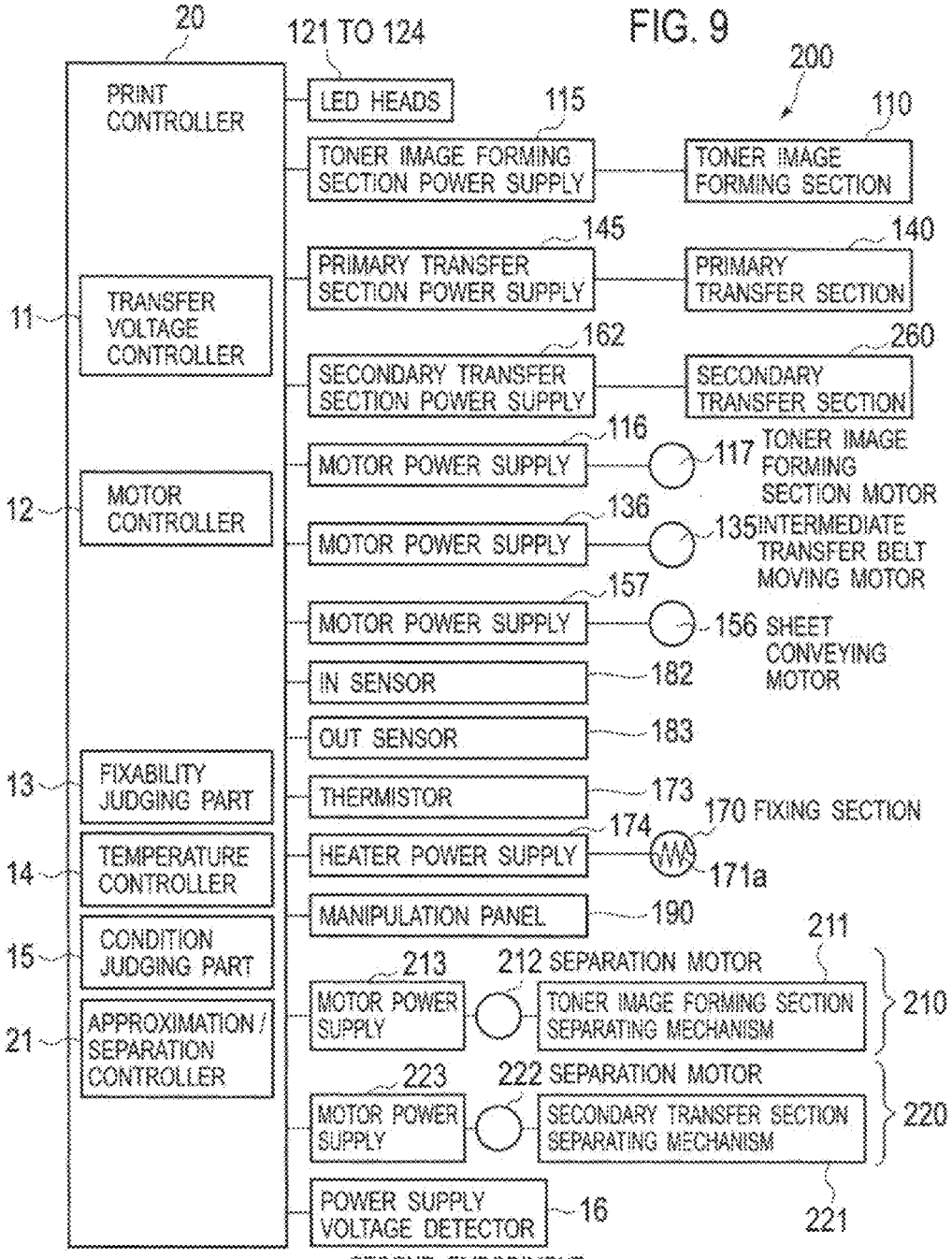
FIG. 9 is a block diagram schematically illustrating a configuration of a control system of the image forming apparatus of the second embodiment.

FIG. 9 is a block diagram schematically illustrating a configuration of a control system of image forming apparatus 200 of the second embodiment. In FIG. 9, components which are the same as those shown in FIG. 2 (the first embodiment) are denoted by the same reference signs. Image forming apparatus 200 of the second embodiment is different from image forming apparatus 100 shown in FIG. 2 (the first embodiment) in that print controller 20 includes: approximation/separation controller 21 that controls the operation of first approximation/separation unit 210 and second approximation/separation unit 220; toner image forming section separating mechanism 211, separation motor 212 and motor power supply 213 included in first approximation/separation unit 210; and toner image forming section separating mechanism 221, separation motor 222 and motor power supply 223 included in second approximation/separation unit 220.

Toner image forming section separating mechanism 211 is, for example, a mechanism configured to move the rotational axes of photosensitive drums 111*a*, 112*a*, 113*a*, 114*a* of toner image forming section 110 in vertical direction Dc. Toner image forming section separating mechanism 211 is, for example, the mechanism configured to: support the rotational axes of photosensitive drums 111*a*, 112*a*, 113*a*, 114*a* of toner image forming section 110 by abutting the axes against inclined surfaces of supporting members 231, 232, 233, 234 which are wedge shaped, respectively; and to move the rotational axes of photosensitive drums 111*a*, 112*a*, 113*a*, 114*a* in the vertical direction Dc by moving supporting members 231, 232, 233, 234 in the horizontal direction (a direction which is orthogonal to the vertical direction Dc, and which is orthogonal to the rotational axes of photosensitive drums 111*a*, 112*a*, 113*a*, 114*a*). It should be noted that the movement of supporting members 231, 232, 233, 234 in the horizontal direction can be achieved by transmitting a driving force of separation motor 212 to supporting members 231, 232, 233, 234 via a power transmission mechanism such as gears (not illustrated). However, toner image forming section separating mechanism 211 is not limited to the above-described example. Toner image forming section separating mechanism 211 may be realized by another configuration configured to move the rotational axes of photosensitive drums 111*a*, 112*a*, 113*a*, 114*a* in the vertical direction orthogonal to the rotational axes.

Secondary transfer section separating mechanism 221 is, for example, a mechanism configured to move the rotational axis of secondary transfer roller 161 in vertical direction Dc. Secondary transfer section separating mechanism 221 is, for example, the mechanism configured to: support the rotational axis of secondary transfer roller 161 by abutting the axis against inclined surfaces of supporting member 241 which is wedge shaped; and to move the rotational axis of secondary transfer roller 161 in the vertical direction Dd by moving supporting member 241 in the horizontal direction (a direction which is orthogonal to vertical direction Dd, and which is orthogonal to the rotational axis of secondary transfer roller 161). It should be noted that the movement of supporting member 241 in the horizontal direction can be achieved by transmitting a driving force of separation motor 222 to the supporting member via a power transmission mechanism such as gears (not illustrated). However, secondary transfer section separating mechanism 221 is not limited to the above-described example. Secondary transfer section separating mechanism 221 may be realized by another configuration configured to move the rotational axis of secondary transfer roller 161 in the direction orthogonal to the rotational axis.

Figure 10:
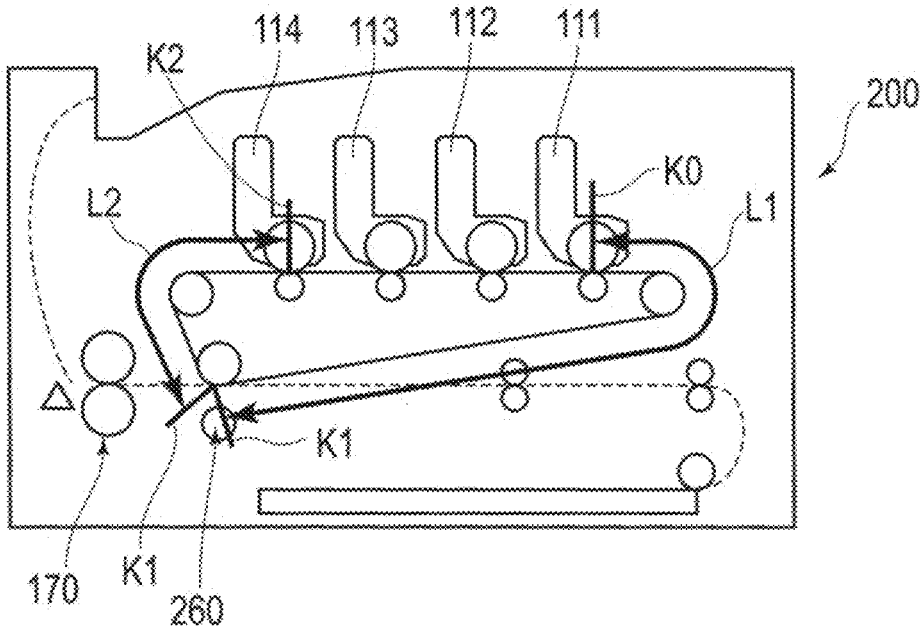
FIG. 10 is a diagram illustrating a distance between a toner image forming section and a secondary transfer section along an intermediate transfer belt in the image forming apparatus of the second embodiment.

FIG. 10 is a diagram for explaining distances between each of two positions on intermediate transfer belt 131. In FIG. 10, reference sign L1 denotes the distance (length), on intermediate transfer belt 131, from position K0 at which a toner image is formed by toner image forming unit 111 (the upmost toner image forming unit in the conveyance direction of intermediate transfer belt 131 in toner image forming section 110) to position K1 at which a part of secondary transfer section 260 comes into contact with sheet P, that is to say, a first distance on intermediate transfer belt 131 from position K0 at which the primary transfer is performed by primary transfer roller 141 located most downstream in the movement direction of intermediate transfer belt 131 to position K1 at which the secondary transfer is performed by secondary transfer section 260. In addition, reference sign L2 denotes a distance (length) on intermediate transfer belt 131 from position K1 at which the part of secondary transfer section 260 comes into contact with sheet P to position K2 at which a toner image is formed by toner image forming unit 114 (the lowermost toner image forming unit in the conveyance direction of intermediate transfer belt 131 in toner image forming section 110), that is to say, a second distance on intermediate transfer belt 131 from position K1 at which the secondary transfer is performed by secondary transfer section 260 to position K2 at which the primary transfer is performed by primary transfer roller 144 located most upstream in the movement direction of intermediate transfer belt 131.

Next, operation of toner image forming section separating mechanism 211 and secondary transfer section separating mechanism 221 is described. Approximation/separation controller 21 in print controller 20 causes separation motor 212 to rotate by controlling the supply of electric power to separation motor 212 by motor power supply 213, and moves supporting members 231, 232, 233, 234 of photosensitive drums 111*a*, 112*a*, 113*a*, 114*a* by transmitting the rotary driving force of separation motor 212 via a power transmission mechanism such as gears, thus moving photosensitive drums 111*a*, 112*a*, 113*a*, 114*a* in the vertical direction Dc. Photosensitive drums 111*a*, 112*a*, 113*a*, 114*a* can be separated from or approximated to intermediate transfer belt 131 through this movement of photosensitive drums 111*a*, 112*a*, 113*a*, 114*a* in the vertical direction Dc. The configuration of secondary transfer section separating mechanism 221 may be similar to that of toner image forming section separating mechanism 211.

When fixability judging part 13 in print controller 20 judges that the temperature of fixing section 170 does not reach the fixable temperature and condition judging part 15 in print controller 20 judges that the condition of image forming apparatus 200 following the input of the first print request is the "abnormal temperature rising condition," e.g., "low voltage condition" image forming apparatus 200 of the second embodiment operates as follows.

When the length of the sheet in the conveyance direction is not more than the distance L1, print controller 20 causes first approximation/separation unit 210 to reduce the space between intermediate transfer belt 131 and photosensitive drums 111*a*, 112*a*, 113*a*, 114*a*, and causes second approximation/separation unit 220 to reduce the space between intermediate transfer belt 131 and secondary transfer roller 161 of secondary transfer section 260. Subsequently, while maintaining these reduced spaces, print controller 20 puts the toner images on intermediate transfer belt 131 on standby at a predetermined position upstream of secondary transfer section 260 in the movement direction after moving the toner images there. Thereafter, print controller 20 causes sheet conveying section 150 to convey the sheet; causes the toner images on intermediate transfer belt 131 to move; and causes secondary transfer section 260 to transfer the toner images on intermediate transfer belt 131 to sheet P.

In addition, when the sheet length is more than the distance L1 but not more than the total value (L1+L2) of the distance L1 and the distance L2, print controller 20 causes the space between intermediate transfer belt 131 and photosensitive drums 111*a*, 112*a*, 113*a*, 114*a* to decrease, and causes the space between intermediate transfer belt 131 and secondary transfer section 260 to decrease. Subsequently, while maintaining these decreased spaces, print controller 20 causes the toner images to be formed on intermediate transfer belt 131. Thereafter, print controller 20 causes photosensitive drums 111*a*, 112*a*, 113*a*, 114*a* to be separated away from intermediate transfer belt 131, and puts the toner images on intermediate transfer belt 131 on standby at a predetermined position upstream of secondary transfer section 260 in the movement direction after moving the toner images there. Afterward, print controller 20 causes transfer roller 160 of secondary transfer section 260 to come into contact with intermediate transfer belt 131. Thereafter, print controller 20 causes sheet P to be conveyed; causes the toner images on intermediate transfer belt 131 to move; and causes secondary transfer section 260 to transfer the toner images on intermediate transfer belt 131 onto sheet P.

When the sheet length is more than the total value (L1+L2) of distance L1 and the distance L2, print controller 20 causes the toner images to be formed on intermediate transfer belt 131 after the temperature of fixing section 170 reaches the fixable temperature; causes sheet P to be conveyed; causes the toner images on intermediate transfer belt 131 to move; and causes secondary transfer section 260 to transfer the toner images on intermediate transfer belt 131 to sheet P.

Figure 11:
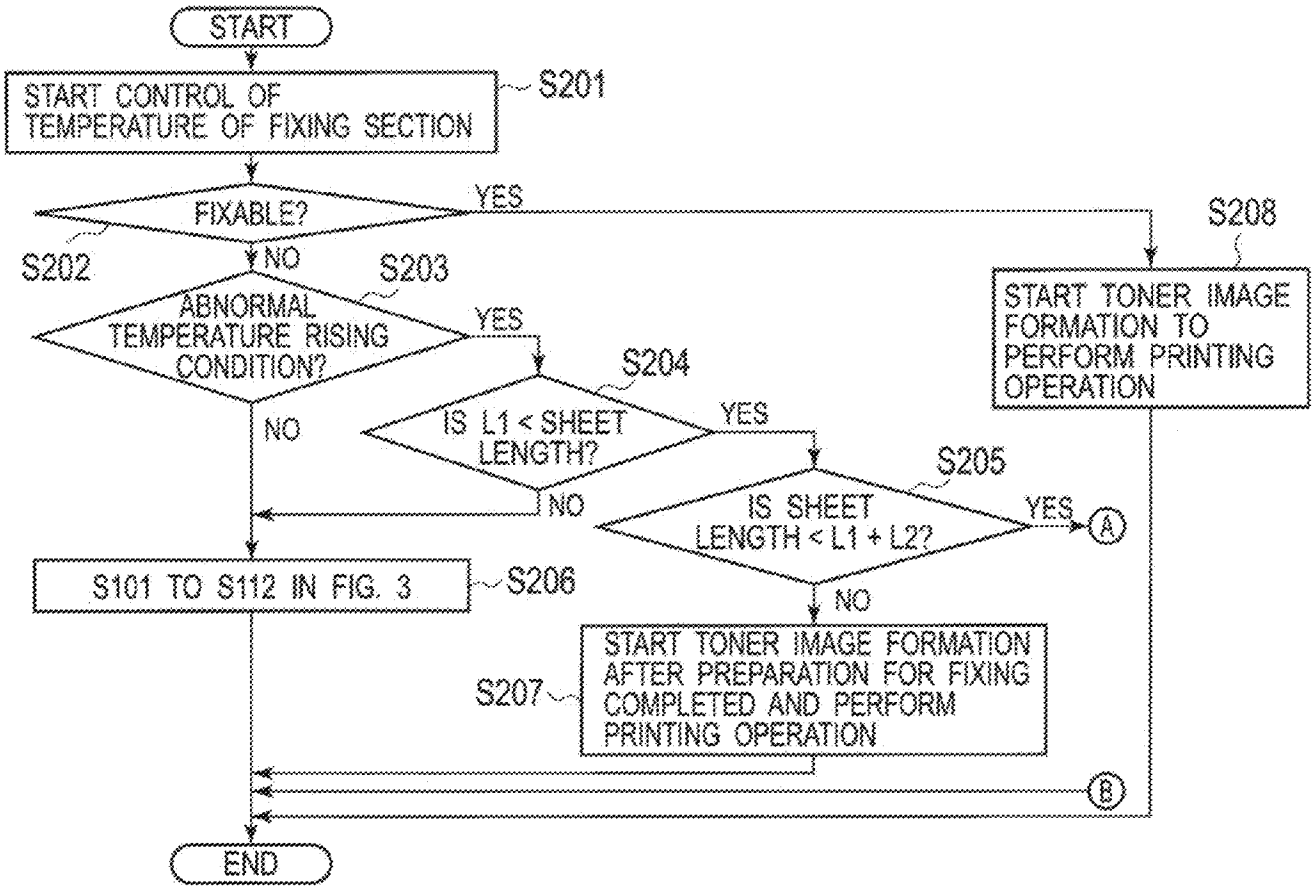
FIG. 11 is a (first) flowchart illustrating how the image forming apparatus of the second embodiment operates.
Figure 12:
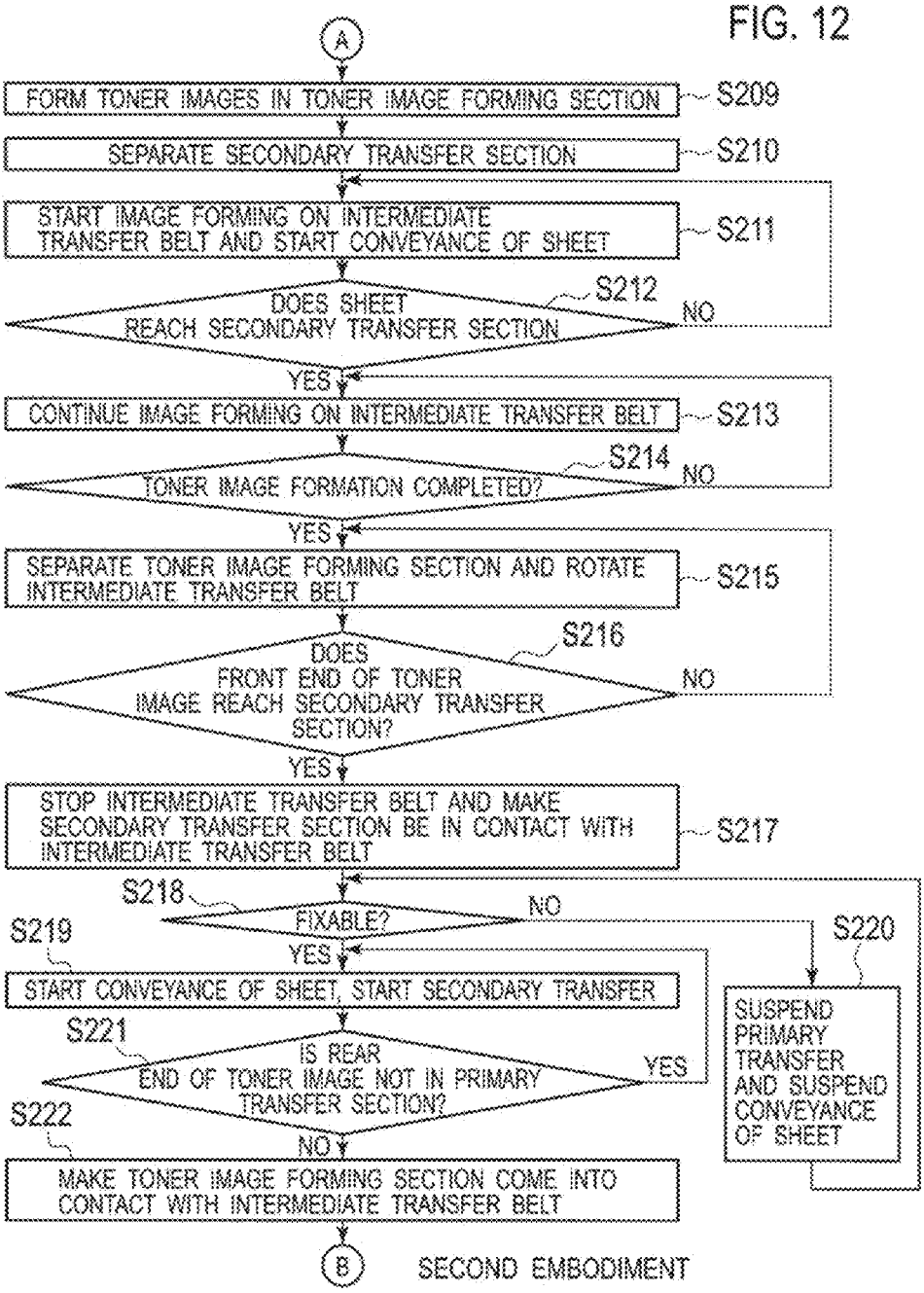
FIG. 12 is a (second) flowchart illustrating how the image forming apparatus of the second embodiment operates.
Figure 14A:
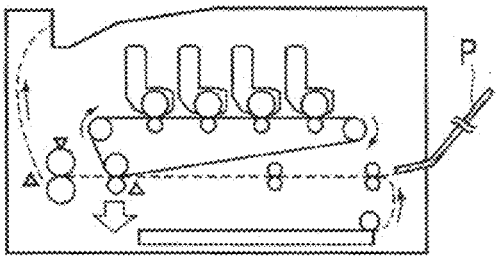
FIGS. 14A to 14F are diagrams for explaining how the image forming apparatus of the second embodiment operates while in the abnormal temperature rising condition.
Figure 14B:
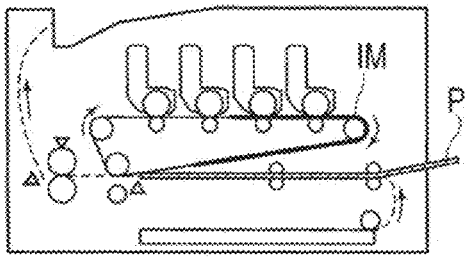
Figure 14C:
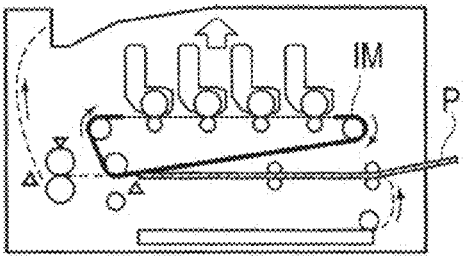
Figure 14D:
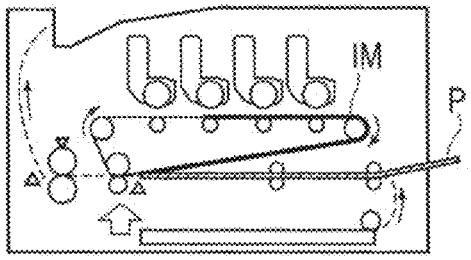
Figure 14E:
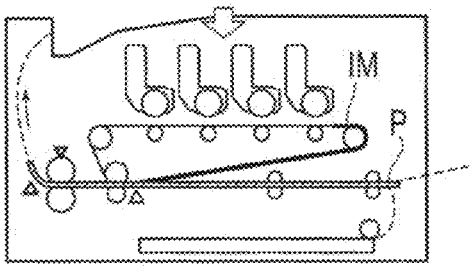
Figure 14F:
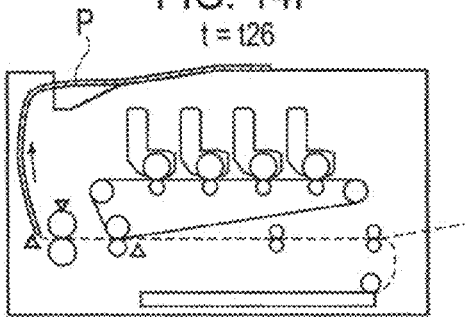

Next, operation of image forming apparatus 200 of the second embodiment is described in detail. FIG. 11 is a (first) flowchart illustrating operation of image forming apparatus 200 of the second embodiment. FIG. 12 is a (second) flowchart illustrating operation of image forming apparatus 200 of the second embodiment. Steps S201, S202, S203, S208 in FIG. 11 are the same as steps S101, S102, S103, S112 in FIG. 3 (the first embodiment), respectively.

Upon reception of the print request from the external apparatus (not illustrated), print controller 20 causes heater power supply 174 to supply electric power to heater 171*a* of fixing section 170, and thus starts to control the temperature of fixing section 170 (in step S201 in FIG. 11).

On the basis of a detection signal from thermistor 173 configured to output the detection signal in accordance with the temperature of fixing section 170, fixability judging part 13 in print controller 20 judges whether or not the temperature of fixing section 170 reaches the predetermined fixable temperature (in step S202 in FIG. 11). If fixability judging part 13 judges in step S202 that the temperature of fixing section 170 is equal to or higher than the predetermined fixable temperature, print controller 20 carries out a process (print process) for: forming toner images on photosensitive drums 111*a*, 112*a*, 113*a*, 114*a*; performing the primary transfer of the toner images onto intermediate transfer belt 131; starting the conveyance of sheet P; and performing the secondary transfer of the toner images onto sheet P (in step S208 in FIG. 11).

If fixability judging part 13 in print controller 20 judges in step S202 that the temperature of fixing section 170 is lower than the fixable temperature, condition judging part 15 in print controller 20 judges whether or not the condition of image forming apparatus 200 is the "abnormal temperature rising condition" (for example, the lower voltage condition) (in step S203 in FIG. 11). The method of judging whether or not the condition of image forming apparatus 200 is the "abnormal temperature rising condition" is the same as the condition judging method of the first embodiment.

If condition judging part 15 in print controller 20 judges in step 203 that the condition of image forming apparatus 200 is the "normal temperature rising condition," (for example, the normal voltage condition) print controller 20 causes the process to proceed to step S206, where print controller 20 carries out processes which are the same as those in step S101 to S112 (in this case, processes which are the same as those in step S106, S108, S111) in FIG. 3 (the first embodiment).

If condition judging part 15 in print controller 203 judges in step 203 that the condition of image forming apparatus 200 is the "abnormal temperature rising condition," (for example, the low voltage condition) print controller 20 compares the sheet length of the sheet to be printed with the distance L1 on intermediate transfer belt 131 (in step S204 in FIG. 11). Incidentally, print controller 20 is capable of recognizing the sheet length by receiving information which the user selects through manipulation panel 190. When judging that the sheet length is shorter than the distance L1, print controller 20 carries out processes, which are the same as those in steps 101 to 112 (in this case, processes which are the same as those in step S104, S105, S107, S109 to S111) in FIG. 3 (the first embodiment), in step S206. When judging that the sheet length is not shorter than the distance L1, print controller 20 causes the process to proceed to step S205.

Subsequently, print controller 20 compares the sheet length with the total distance value (L1+L2) (in step S205 in FIG. 11). The total distance value (L1+L2) corresponds to the distance on intermediate transfer belt 131 from the most downstream position to the most upstream position of the primary transfer section. When judging in step S205 that the sheet length is not shorter than the total distance value (L1+L2), print controller 20 causes toner image forming section 110 and primary transfer section 140, respectively, to start the toner image formation and the primary transfer after fixability judging part 13 judges that the temperature of fixing section 170 reaches the fixable temperature. Thereafter, print controller 20 causes sheet conveying section 150 to start the conveyance of sheet P at a predetermined time, and subsequently causes secondary transfer section 260 and fixing section 170, respectively, to carry out the secondary transfer process and the thermal fixing process (in step S207 in FIG. 11). In this case, it is impossible to reduce the time needed for the print of the first sheet to be completed, because the print process is started after fixability judging part 13 judges that the temperature of fixing section 170 reaches the fixable temperature.

When judging in step S205 that the sheet length is shorter than the total distance value (L1+L2), print controller 20 causes the process to proceed to step S209 in FIG. 12. In this case, the time needed for the print to be completed can be reduced by using the below-described processes.

In step S209 in FIG. 12, print controller 20 causes toner image forming section 110 to start the toner image formation. In parallel with this process, motor controller 12 in print controller 20 causes toner image forming section motor 117 and intermediate transfer belt moving motor 135 to start their drives.

Subsequently, approximation/separation controller 21 in print controller 20 causes secondary transfer section separating mechanism 221 to operate to separate transfer roller 160 of secondary transfer section 260 away from intermediate transfer belt 131 (in step S210 in FIG. 12).

Thereafter, transfer voltage controller 11 in print controller 20 causes the toner images on photosensitive drums 111*a*, 112*a*, 113*a*, 114*a* of toner image forming section 110 to be transferred onto intermediate transfer belt 131 (primary transfer) by controlling the application of the transfer voltage to the primary transfer section 140. In parallel with this operation, motor controller 13 of print controller 20 causes sheet conveying section 150 to start the conveyance of sheet P (in step S211 in FIG. 12).

Once print controller 20 detects that sheet P is conveyed to a position immediately before secondary transfer section 260 on the basis of a result of detection by IN sensor 182, motor controller 13 in print controller 20 causes sheet conveying section 150 to suspend the conveyance of sheet P (in step S212 in FIG. 12).

Print controller 20 causes toner image forming section 110 and primary transfer section 140 to continue forming toner images IN to intermediate transfer belt 131 until toner images IM corresponding to the sheet length finishes being formed on intermediate transfer belt 131 (in step S213 in FIG. 12). In parallel with this operation, print controller 20 causes intermediate transfer belt moving motor 135 to continue moving intermediate transfer belt 131.

Once toner images IM corresponding to the sheet length finish being formed on intermediate transfer belt 131, print controller 20 completes the toner image forming process (in step S214 in FIG. 12).

Subsequently, approximation/separation controller 21 in print controller 20 causes toner image forming section separating mechanism 211 to operate to separate transfer roller 160 of toner image forming section 110 away from intermediate transfer belt 131 (in step S215 in FIG. 12). On this occasion, motor controller 12 in print controller 20 may be configured to cause intermediate transfer belt 131 to temporarily stop. In this case, motor controller 12 is configured to cause intermediate transfer belt 131 to resume movement once the separating operation is completed. The foregoing process puts both photosensitive drums 111*a*, 112*a*, 113*a*, 114*a* and secondary transfer roller 161 in the state of being separated from intermediate transfer belt 131. While maintaining this state, motor controller 12 in print controller 20 causes intermediate transfer belt 131 to move.

Subsequently, print controller 20 detects the position of toner images IM on the basis of the amount of movement of intermediate transfer belt 131 by motor controller 12, and thus causes toner images IM to move to the position immediately before secondary transfer section 260 (in step S216 in FIG. 12).

Motor controller 12 in print controller 20 causes intermediate transfer belt 131 to stop. Subsequently, approximation/separation controller 21 causes secondary transfer roller 161 of secondary transfer section 260 to come into contact with intermediate transfer belt 131 by controlling secondary transfer section separating mechanism 221 (in step S217 in FIG. 12).

Fixability judging part 13 in print controller 20 puts the print process on standby by causing toner image forming section 119 to suspend the toner image formation, and causing the conveyance of sheet P to be suspended, until the temperature of the fixing roller is judged to have reached the fixable temperature (in step S218 in FIG. 12).

Once fixability judging part 13 judges that the temperature of fixing roller 171 reaches the fixable temperature, print controller 20 resumes the print process. To put it specifically, motor controller 12 resumes the movement of intermediate transfer belt 131; sheet conveying part 15 resumes the conveyance of sheet P; and transfer voltage controller 11 resumes the application of the voltage to secondary transfer section 260 (in step S219 in FIG. 12).

Print controller 20 measures the amount of movement of intermediate transfer belt 131 by motor controller 12. Once print controller 20 detects that the trailing edge of toner images IM moves to toner image forming unit 111 (namely, the most downstream position (position K0 in FIG. 10) of toner image forming section 110 in the movement direction of intermediate transfer belt 131), print controller 20 causes photosensitive drums 111*a*, 112*a*, 113*a*, 114*a* of toner image forming section 110 to come into contact with intermediate transfer belt 131 by causing approximation/separation controller 21 to control toner image forming section separating mechanism 211 (in steps S221, S222 in FIG. 12).

In the case where the condition of image forming apparatus 200 is judged as being the "abnormal temperature rising condition," the implementation of the foregoing process makes it possible to reduce the time needed for the print to be completed while preventing fixation failure even if the sheet length is longer than the distance L1.

Next, an example of the operation of the image forming apparatus in the case where the print request occurs when the condition of the image forming apparatus is the "abnormal temperature rising condition," for example, the low voltage condition (in step S209 and ensuing steps in FIG. 12). FIGS. 13A to 13J are timing diagrams illustrating operation of image forming apparatus 200 of the second embodiment when the condition of image forming apparatus 200 is the "abnormal temperature rising condition." FIG. 13A shows the temperature of fixing roller 171. FIG. 13B shows ON periods and OFF periods (periods other than the ON periods) of heater 171*a*. FIG. 13C shows a period of the process performed by primary transfer section 140. FIG. 13D shows states in which photosensitive drums 111*a*, 112*a*, 113*a*, 114*a* are put by toner image forming section separating mechanism 211. FIG. 13E shows movement periods of intermediate transfer belt 131. FIG. 13F shows states in which secondary transfer roller 161 is put by secondary transfer section separating mechanism 221. FIG. 13G shows a period of the process performed by secondary transfer section 260. FIG. 13H shows operation periods of sheet conveying section 150. FIG. 13I shows an operation period of IN sensor 182. FIG. 13J shows an operation period of OUT sensor 183.

FIGS. 14A to 14F are diagrams illustrating operation of image forming apparatus 200 of the second embodiment while in the "abnormal temperature rising condition." In addition, time t20 to time t26 in FIGS. 13A to 13J are identical to time t20 to time t26 in FIGS. 14A to 14F.

Once the print process starts in response to the occurrence of the first print request at time t20 (FIG. 13A), temperature controller 14 starts to control the heating of heater 171*a* (FIG. 13B), transfer voltage controller 11 and motor controller 12 start to cause primary transfer section 140 and toner image forming section 110 to perform toner image forming (FIG. 13C), approximation/separation controller 21 starts to perform the separation process of secondary transfer section 260 (FIG. 13F), motor controller 12 starts to move intermediate transfer belt 131 (FIG. 13E), and motor controller 12 starts conveyance of sheet P by sheet conveying section 150 (FIG. 13H). At time t20, no toner images IM are formed, and conveyance of sheet P is not yet started.

Time t21 denotes the time at which the leading edge of sheet P reaches a position immediately before secondary transfer section 260. Print controller 20 judges the position of sheet P on the basis of a result of detection by IN sensor 182 (FIG. 13I), and causes sheet conveying section 15 to suspend the conveyance of sheet P (FIG. 13H). At time t21, toner images IM are in the process of being formed, and sheet P reaches the position immediately before secondary transfer section 260.

Time t22 denotes the time at which the toner image formation is completed. Once the primary transfer process (FIG. 13C) is completed, toner image forming section separating mechanism 211 (FIG. 13D) separates toner image forming section 110 from intermediate transfer belt 131. At time t22, the leading edges of toner images IM are located between the most upstream portion (position K2) of primary transfer section 140 and secondary transfer section 260. Subsequently, toner image forming section separating mechanism 211 separates toner image forming section 110 from intermediate transfer belt 131.

Time t23 denotes the time at which the leading edges of toner images IM move to the position immediately before secondary transfer section 260. The movement of intermediate transfer belt 131 (FIG. 13E) is suspended, and the separation of secondary transfer section separating mechanism (FIG. 13F) is released. Subsequently, intermediate transfer belt 131 and secondary transfer roller 161 of secondary transfer section 260 are brought into contact with each other. At time t23, both sheet P and toner images IM are located in the position immediately before secondary transfer section 260, and photosensitive drums 111*a*, 112*a*, 113*a*, 114*a* of toner image forming section 110 are in the state of being separated from intermediate transfer belt 131.

Time t24 denotes the time at which the temperature of fixing section 170 reaches the fixable temperature. At time t24, the movement of intermediate transfer belt 131 (FIG. 13E), the control of the voltage of secondary transfer section (FIG. 13G), and the conveyance of sheet P by sheet conveying section 150 (FIG. 13H) are resumed. The conditions and positions of the sections and parts at time t24 remain the same as those at time t23.

Time t25 denotes the time at which the trailing edges of toner images IM finish passing the most downstream portion (position K0) of primary transfer section 140. At time t25, toner image forming section separating mechanism 211 (FIG. 13D) causes photosensitive drums 111*a*, 112*a*, 113*a*, 114*a* to come into contact with intermediate transfer belt 131 by releasing their separation.

Time t26 denotes the time at which the trailing edge of sheet P passes OUT sensor 183. Thereafter, the conveyance of sheet P continues, and the print is completed.

As described above, even when the temperature of fixing section 260 does not reach the fixable temperature and the condition of image forming apparatus 200 is judged as being the "abnormal temperature rising condition," image forming apparatus 200 of the second embodiment makes it possible to reduce the time needed for the print, in particular, the time needed for the print of the first sheet to be completed, by using the scheme in which: when the sheet length is less than the distance L1, image forming apparatus 200 carries out the same processes as in the first embodiment; and when the sheet length is not less than the distance L1 but less than the total value (L1+L2), image forming apparatus 200 carries out the processes shown in FIG. 12, FIGS. 13A to 13H and FIGS. 14A to 14F.

In addition, even in a case where the power supply voltage is unstable, image forming apparatus 200 of the second embodiment can reduce the frequency at which fixation failure occurs. That is because: image forming apparatus 200 completes part of the print process which is to be performed before secondary transfer section 260 undertakes its own part of the print process, and holds the remaining part of the print process in abeyance; and image forming apparatus 200 resumes the print process once it is judged as becoming ready for fixation.

Furthermore, image forming apparatus 200 of the second embodiment makes it possible to reduce the length of intermediate transform belt 131. For this reason, image forming apparatus 200 can be easily constructed in a smaller size.

Moreover, image forming apparatus 200 of the second embodiment stops sheet conveying section 150 and toner image conveying section 130 to standby until the temperature of fixing section 170 reaches the fixable temperature. For this reason, it is possible to reduce the power consumption of image forming apparatus 100.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus comprising:

a toner image forming section including an image carrier, and configured to form a toner image on the image carrier;

a toner image conveying section including an intermediate transfer member and a moving part configured to move the intermediate transfer member in a predetermined movement direction;

a primary transfer section configured to transfer the toner image on the image carrier onto the intermediate transfer member;

a recording medium conveying section configured to convey a recording medium in a predetermined conveyance direction;

a secondary transfer section configured to transfer the toner image on the intermediate transfer member onto the recording medium;

a fixing section including a heater, and configured to heat the toner image on the recording medium with the heater;

a fixability judging part configured to judge whether or not a temperature of the fixing section reaches a fixable temperature;

a condition judging part configured to judge whether or not a condition of the image forming apparatus following input of a first print request into the image forming apparatus is an abnormal temperature rising condition in which an estimated value of a rise time needed for the temperature of the fixing section to reach the fixable temperature exceeds a predetermined reference time;

a temperature detector configured to detect the temperature of the fixing section; and a print controller, wherein, on a basis of the temperature detected by the temperature detector, the condition judging part judges whether the condition following the input of the first print request is a normal temperature rising condition or the abnormal temperature rising condition, wherein when the fixability judging part judges that the temperature of the fixing section has not yet reached the fixable temperature and the condition judging part judges that the condition of the image forming apparatus is the abnormal temperature rising condition, the print controller causes the toner image conveying section to move the toner image on the intermediate transfer member to a predetermined toner image standby position upstream of the secondary transfer section in the movement direction and to put the toner image on standby at the toner image standby position, and causes the recording medium conveying section to put the recording medium on standby at a predetermined sheet standby position upstream of the secondary transfer section in the conveyance direction, and thereafter, when the fixability judging part judges that the temperature of the fixing section reaches the fixable temperature, the print controller causes the secondary transfer section to transfer the toner image on the intermediate transfer member onto the recording medium, wherein the condition judging part:

calculates an amount of change in the temperature which the temperature detector detects at intervals of a predetermined length of time for a predetermined period of time after the input of the first print request, judges that the condition of the image forming apparatus is the normal temperature rising condition, when a maximum value or an average value of the amounts of change in temperature is not less than a predetermined amount-of-change-in-temperature threshold value, and judges that the condition of the image forming apparatus is the abnormal temperature rising condition, when the condition judging part does not judge that the condition of the image forming apparatus is the normal temperature rising condition.

2. The image forming apparatus according to claim 1, wherein the condition judging part:

calculates an amount of change in the temperature which the temperature detector detects at intervals of a predetermined length of time for a predetermined period of time after the input of the first print request, judges that the condition of the image forming apparatus is the normal temperature rising condition, when all or some of the amounts of change in temperature are not less than a predetermined amount-of-change-in-temperature threshold value, and judges that the condition of the image forming apparatus is the abnormal temperature rising condition, when the condition judging part does not judge that the condition of the image forming apparatus is the normal temperature rising condition.

3. The image forming apparatus according to claim 1, further comprising a user manipulation section through which to input an instruction signal for causing the print controller to execute an operation which is to be performed when the condition of the image forming apparatus is the abnormal temperature rising condition.

4. The image forming apparatus according to claim 1, wherein, when the fixability judging part judges that the temperature of the fixing section reaches the fixable temperature, the print controller causes: the toner image forming section to form the toner image; the primary transfer section to transfer the toner image onto the intermediate transfer member; the toner image conveying section to convey the toner image; the recording medium conveying section to convey the recording medium; the secondary transfer section to transfer the toner image on the intermediate transfer member onto the recording medium; and the fixing section to fix the toner image onto the recording medium.

5. The image forming apparatus according to claim 1, wherein a distance from the secondary transfer section to the fixing section is shorter than a length of a smallest recording medium, which is usable as the recording medium, in the conveyance direction.

6. An image forming apparatus comprising:

a toner image forming section including an image carrier, and configured to form a toner image on the image carrier;

a toner image conveying section including an intermediate transfer member and a moving part configured to move the intermediate transfer member in a predetermined movement direction;

a primary transfer section configured to transfer the toner image on the image carrier onto the intermediate transfer member;

a recording medium conveying section configured to convey a recording medium in a predetermined conveyance direction;

a secondary transfer section configured to transfer the toner image on the intermediate transfer member onto the recording medium;

a fixing section including a heater, and configured to heat the toner image on the recording medium with the heater;

a fixability judging part configured to judge whether or not a temperature of the fixing section reaches a fixable temperature;

a condition judging part configured to judge whether or not a condition of the image forming apparatus following input of a first print request into the image forming apparatus is an abnormal temperature rising condition in which an estimated value of a rise time needed for the temperature of the fixing section to reach the fixable temperature exceeds a predetermined reference time;

a print controller; and a power supply voltage detector configured to detect a power supply voltage of the heater, wherein when the fixability judging part judges that the temperature of the fixing section has not yet reached the fixable temperature and the condition judging part judges that the condition of the image forming apparatus is the abnormal temperature rising condition, the print controller causes the toner image conveying section to move the toner image on the intermediate transfer member to a predetermined toner image standby position upstream of the secondary transfer section in the movement direction and to put the toner image on standby at the toner image standby position, and causes the recording medium conveying section to put the recording medium on standby at a predetermined sheet standby position upstream of the secondary transfer section in the conveyance direction, and thereafter, when the fixability judging part judges that the temperature of the fixing section reaches the fixable temperature, the print controller causes the secondary transfer section to transfer the toner image on the intermediate transfer member onto the recording medium, and wherein, on a basis of the power supply voltage which the power supply voltage detector detects for a predetermined period of time after the input of the first print request, the condition judging part judges whether the condition following the input of the first print request is a normal temperature rising condition or the abnormal temperature rising condition.

7. The image forming apparatus according to claim 6, wherein the condition judging part calculates the power supply voltage which the power supply voltage detector detects at intervals of a predetermined length of time for the predetermined period of time after the input of the first print request, judges that the condition of the image forming apparatus is the normal temperature rising condition, when all or some of the power supply voltages are not less than a predetermined power-supply-voltage threshold value, and judges that the condition of the image forming apparatus is the abnormal temperature rising condition, when the condition judging part does not judge that the condition of the image forming apparatus is the normal temperature rising condition.

8. The image forming apparatus according to claim 6, wherein the condition judging part calculates the power supply voltage which the power supply voltage detector detects at intervals of a predetermined length of time for the predetermined period of time after the input of the first print request, judges that the condition of the image forming apparatus is the normal temperature rising condition, when a maximum value or an average value of the power supply voltages is not less than a predetermined power-supply-voltage threshold value, and judges that the condition of the image forming apparatus is the abnormal temperature rising condition, when the condition judging part does not judge that the condition of the image forming apparatus is the normal temperature rising condition.

9. An image forming apparatus comprising:

a toner image forming section including an image carrier, and configured to form a toner image on the image carrier;

a toner image conveying section including an intermediate transfer member and a moving part configured to move the intermediate transfer member in a predetermined movement direction;

a primary transfer section configured to transfer the toner image on the image carrier onto the intermediate transfer member;

a recording medium conveying section configured to convey a recording medium in a predetermined conveyance direction;

a secondary transfer section configured to transfer the toner image on the intermediate transfer member onto the recording medium;

a fixing section including a heater, and configured to heat the toner image on the recording medium with the heater;

a fixability judging part configured to judge whether or not a temperature of the fixing section reaches a fixable temperature;

a condition judging part configured to judge whether or not a condition of the image forming apparatus following input of a first print request into the image forming apparatus is an abnormal temperature rising condition in which an estimated value of a rise time needed for the temperature of the fixing section to reach the fixable temperature exceeds a predetermined reference time; and a print controller, wherein when the fixability judging part judges that the temperature of the fixing section has not yet reached the fixable temperature and the condition judging part judges that the condition of the image forming apparatus is the abnormal temperature rising condition, the print controller causes the toner image conveying section to move the toner image on the intermediate transfer member to a predetermined toner image standby position upstream of the secondary transfer section in the movement direction and to put the toner image on standby at the toner image standby position, and causes the recording medium conveying section to put the recording medium on standby at a predetermined sheet standby position upstream of the secondary transfer section in the conveyance direction, and thereafter, when the fixability judging part judges that the temperature of the fixing section reaches the fixable temperature, the print controller causes the secondary transfer section to transfer the toner image on the intermediate transfer member onto the recording medium, wherein, when the fixability judging part judges that the temperature of the fixing section has not yet reached the fixable temperature and the condition judging part judges that the condition of the image forming apparatus following the input of the first print request is a normal temperature rising condition, the print controller calculates the estimated value of the rise time needed for the temperature of the fixing section to reach the fixable temperature, and once the estimated value of the rise time becomes less than a time needed for the recording medium to reach the fixing section, the print controller causes: the recording medium conveying section to convey the recording medium; the secondary transfer section to transfer the toner image on the intermediate transfer member onto the recording medium; and the fixing section to fix the toner image to the recording medium.

10. An image forming apparatus comprising:

a toner image forming section including an image carrier, and configured to form a toner image on the image carrier;

a toner image conveying section including an intermediate transfer member and a moving part configured to move the intermediate transfer member in a predetermined movement direction;

a primary transfer section configured to transfer the toner image on the image carrier onto the intermediate transfer member;

a recording medium conveying section configured to convey a recording medium in a predetermined conveyance direction;

a secondary transfer section configured to transfer the toner image on the intermediate transfer member onto the recording medium;

a fixing section including a heater, and configured to heat the toner image on the recording medium with the heater;

a fixability judging part configured to judge whether or not a temperature of the fixing section reaches a fixable temperature;

a condition judging part configured to judge whether or not a condition of the image forming apparatus following input of a first print request into the image forming apparatus is an abnormal temperature rising condition in which an estimated value of a rise time needed for the temperature of the fixing section to reach the fixable temperature exceeds a predetermined reference time;

a print controller;

a first approximation/separation unit configured to change a space between the intermediate transfer member and the image carrier; and a second approximation/separation unit configured to change a space between the intermediate transfer member and the secondary transfer section, wherein when the fixability judging part judges that the temperature of the fixing section has not yet reached the fixable temperature and the condition judging part judges that the condition of the image forming apparatus is the abnormal temperature rising condition, the print controller causes the toner image conveying section to move the toner image on the intermediate transfer member to a predetermined toner image standby position upstream of the secondary transfer section in the movement direction and to put the toner image on standby at the toner image standby position, and causes the recording medium conveying section to put the recording medium on standby at a predetermined sheet standby position upstream of the secondary transfer section in the conveyance direction, and thereafter, when the fixability judging part judges that the temperature of the fixing section reaches the fixable temperature, the print controller causes the secondary transfer section to transfer the toner image on the intermediate transfer member onto the recording medium, wherein, in a case where a first distance is defined as a length on the intermediate transfer member from a position at which a primary transfer is performed by a part of the primary transfer section located most downstream in the movement direction of the intermediate transfer member to a position at which a secondary transfer is performed by the secondary transfer section, and a second distance is defined as a length on the intermediate transfer member from the position at which the secondary transfer is performed by the secondary transfer section to a position at which a primary transfer is performed by another part of the primary transfer section located most upstream in the movement direction of the intermediate transfer member, as an operation to be performed when the fixability judging part judges that the temperature of the fixing section has not yet reached the fixable temperature and the condition judging part judges that the condition of the image forming apparatus following the input of the first print request into the image forming apparatus is the abnormal temperature rising condition, when a length of the recording medium in the conveyance direction is judged as being not more than the first distance, the print controller causes the first approximation/separation unit to reduce the space between the intermediate transfer member and the image carrier, and the second approximation/separation unit to reduce the space between the intermediate transfer member and the secondary transfer section; and causes the toner image on the intermediate transfer member to be moved to the predetermined toner image standby position upstream of the secondary transfer section in the movement direction to be put on standby at the toner image standby position, and causes the recording medium conveying section to put the recording medium on standby at the predetermined sheet standby position upstream of the secondary transfer section in the conveyance direction, while maintaining the reduced spaces, and thereafter, the print controller causes the recording medium conveying section to convey the recording medium in the conveyance direction, the toner image conveying section to move the toner image on the intermediate transfer member in the movement direction, and the secondary transfer section to transfer the toner image on the intermediate transfer medium onto the recording medium.

11. The image forming apparatus according to claim 10, wherein, when the length of the recording medium in the conveyance direction is judged as being more than the first distance and not more than a total value of the first and the second distances, the print controller causes: the first approximation/separation unit to reduce the space between the intermediate transfer member and the image carrier; and the second approximation/separation unit to reduce the space between the intermediate transfer member and the secondary transfer section; and causes the toner image to be formed on the intermediate transfer member while maintaining the reduced spaces, thereafter, the print controller causes: the first approximation/separation unit to increase the space between the intermediate transfer member and the image carrier; causes the toner image on the intermediate transfer member to be moved to the predetermined toner image standby position upstream of the secondary transfer section in the movement direction to be put on standby at the toner image standby position; and causes the recording medium conveying section to put the recording medium on standby at the predetermined sheet standby position upstream of the secondary transfer section in the conveyance direction, and subsequently, the print controller causes: the second approximation/separation unit to reduce the space between the intermediate transfer member and the secondary transfer section; the recording medium conveying section to convey the recording medium in the conveyance direction; the toner image conveying section to move the toner image on the intermediate transfer member in the movement direction; and the secondary transfer section to transfer the toner image on the intermediate transfer member onto the recording medium.

12. The image forming apparatus according to claim 10, wherein, when the length of the recording medium in the conveyance direction is judged as being more than a total value of the first and the second distances, the print controller causes: the toner image to be formed on the intermediate transfer section after the temperature of the fixing section reaches the fixable temperature; the recording medium conveying section to convey the recording medium in the conveyance direction; the toner image conveying section to move the toner image on the intermediate transfer member in the movement direction; and the secondary transfer section to transfer the toner image on the intermediate transfer member onto the recording medium.

* * * * *